US007874090B2

(12) United States Patent
Flagg

(10) Patent No.: US 7,874,090 B2
(45) Date of Patent: Jan. 25, 2011

(54) FREE STANDING MODULAR DISPLAY

(75) Inventor: Rodger H. Flagg, 10504 Daysailer Dr., Fairfax Station, VA (US) 22039

(73) Assignee: Rodger H. Flagg, Fairfax Station, VA (US)

( * ) Notice: Subject to any disclaimer, the term of this patent is extended or adjusted under 35 U.S.C. 154(b) by 0 days.

(21) Appl. No.: 12/662,890

(22) Filed: May 11, 2010

(65) Prior Publication Data

US 2010/0293828 A1 Nov. 25, 2010

Related U.S. Application Data

(60) Provisional application No. 61/213,152, filed on May 12, 2009.

(51) Int. Cl.

| | |
|---|---|
| ***G09F 7/00*** | (2006.01) |
| ***G09F 15/00*** | (2006.01) |
| ***G09F 15/02*** | (2006.01) |
| ***G09F 3/20*** | (2006.01) |
| ***A47G 5/00*** | (2006.01) |
| ***E06B 9/00*** | (2006.01) |
| ***E06B 9/24*** | (2006.01) |

(52) U.S. Cl. ..... 40/605; 40/606.01; 40/606.12; 40/606.13; 40/606.14; 40/607.04; 40/610; 40/658; 160/135; 160/351; 160/352; 160/371; 160/372; 160/374.1; 160/376; 160/378; 211/175; 211/182; 211/180; 211/189; 211/195; 211/199; 248/158; 248/127; 248/159; 248/146; 248/125.1; 135/117; 116/63 P

(58) Field of Classification Search ..... 40/605, 40/606.01, 606.12, 606.13, 606.14, 607.04, 40/610; 211/175, 180, 182, 189, 195, 199; 160/135, 351, 352, 371, 372, 374.1, 376, 160/378; 248/158, 127, 125.1, 146, 176.1, 248/460, 160, 165; 116/63 P; 135/117
See application file for complete search history.

(56) References Cited

U.S. PATENT DOCUMENTS

| | | | | |
|---|---|---|---|---|
| 1,944,696 | A | | 1/1934 | Reichl |
| 2,790,258 | A | * | 4/1957 | Freshour ..... 40/610 |
| 3,685,666 | A | | 8/1972 | Rose |
| 3,875,711 | A | | 4/1975 | Palmer |
| 4,194,313 | A | | 3/1980 | Downing |
| 4,373,570 | A | | 2/1983 | Nussdorf |

(Continued)

(Continued)

*Primary Examiner*—Joanne Silbermann
*Assistant Examiner*—Syed A Islam
(74) *Attorney, Agent, or Firm*—Ryan Ward

(57) ABSTRACT

At least two upright subassemblies, each with a base, radial positioning members; an outer tubular member, an inner tubular member slidably received in the outer tubular member; a plunger for selective engagement with aperture(s) in the outer tubular member, upper and lower horizontal bars secured to the radial positioning members, and a flexible display secured to each set of upper and lower horizontal bars, the radial positioning members for selective positioning between selected convex, concave, in-line and right angle positions.

19 Claims, 16 Drawing Sheets

U.S. PATENT DOCUMENTS

| | | | | |
|---|---|---|---|---|
| 4,700,498 | A | 10/1987 | Perutz | |
| 4,722,146 | A | 2/1988 | Kemeny | |
| 4,821,787 | A | 4/1989 | Swanson | |
| 4,958,671 | A | 9/1990 | Bove | |
| 5,375,641 | A | 12/1994 | Schlueter | |
| 5,607,070 | A | 3/1997 | Hellyer | |
| 6,038,802 | A | 3/2000 | Tidwell | |
| 6,161,320 | A | 12/2000 | Peterson | |
| 6,189,594 | B1 | 2/2001 | Carter | |
| 6,226,931 | B1 | 5/2001 | Haversat | |
| 6,370,803 | B1 * | 4/2002 | Burquest | 40/607.04 |
| 6,718,669 | B1 | 4/2004 | Hayes | |
| 7,140,134 | B1 | 11/2006 | Flagg | |
| 7,337,567 | B2 | 3/2008 | Fritsche | |
| 7,520,076 | B2 | 4/2009 | Flagg | |
| 2003/0070770 | A1 | 4/2003 | Nussdorf | |
| 2005/0039412 | A1 | 2/2005 | Fritsche | |
| 2009/0000169 | A1 | 1/2009 | Houssain | |

* cited by examiner

FREE STANDING MODULAR DISPLAY

CROSS-REFERENCE TO RELATED TOPICS

This disclosure claims priority of provisional patent application 61/213,152 filed May 12, 2009, entitled: FREE STANDING MODULAR DISPLAY, which is incorporated in full by reference herein.

STATEMENT REGARDING FEDERALLY SPONSORED RESEARCH OR DEVELOPMENT

Not applicable

REFERENCE TO SEQUENCE LISTING A TABLE, OR A COMPUTER PROGRAM LISTING COMPACT DISK APPENDIX

Not applicable

For purposes of this disclosure, the term "releasably secured" is intended to convey a fastening means which may be selectively, manually secured or released by a user's hand, without the need for hand tools or power tools.

BACKGROUND OF THE INVENTION

Tradeshows and events offer limited booth space to individuals and large and small businesses for a fee. Often a tradeshow lasts several days, and the user selects booth space in accordance with their budget and their display needs. Some booth space is as small as a six foot table. Usually, booth space is rented in multiples of 10 foot lengths by 10 foot widths, 10 foot lengths by 15 foot widths, 10 foot lengths by 20 foot widths, and a variety of larger sizes. Costs vary by square feet, projected attendance, type of tradeshow, etc. Larger corporations often rent larger booth space. The appearance of the booth, the booth personnel, and the quality of products displayed all affect the success of the tradeshow experience.

Many new retirees are not ready to stop working, and will opt to start new businesses, to supplement their retirement pensions and savings. They will need to seek new customers, clients and partnerships, and one venue for growing a business is through participation at tradeshows and events. With the pending retirement of hundreds of thousands of baby boomers each year for the next twenty years, there is a need to provide an easily transportable, light weight, low cost, and free-standing displays, that do not require expensive set up or take down, and are easy to transport, set-up, display, and take down.

Pop up floor displays are popular, but they take up valuable booth space, and are expensive.

Banner stands are easy to set up, and less expensive, but come in limited widths, usually 30 to 40 inches wide. They rollup into a base, and are typically supported by a single upright member.

Rigid backdrops are often customized for use in larger booth configurations, and often require a trained crew to assemble and disassemble. Rigid backdrops require large containers to ship, which are expensive to transport, set-up, and store between use.

SUMMARY OF THE INVENTION

Therefore, what is needed is an inexpensive, easy to transport, free standing, extendable, modular display assembly. Each modular display assembly comprises two or more upright sub-assemblies. Each upright sub-assembly includes a base portion; a set of first and second radial positioning members adjustably positioned and selectively, releasably secured above the base portion in one of at least two positions selected from: in line, concave, convex and right angle positions. Preferably any one of the four positions may be selected. An outer tubular member is secured above the first and second radial positioning members; and an inner tubular member is slidably received within at least a portion of the outer tubular member. A set of third and fourth radial positioning members are adjustably positioned and selectively, releasably secured above the upper end of the inner tubular member in one of at least two positions selected from in line, concave, convex and right angle positions. The inner tubular member is slidably received and releasably secured within the outer tubular member between extended and retracted position(s).

Therefore, one object of this invention is to provide a new and improved free standing modular display assembly for tradeshows and events, with at least two upright sub-assemblies which are each vertically extendable for display, and retractable for ease of transport and storage.

Another object of this invention is to provide an elongated base member with a raised horizontal center portion, with first and second opposing, depending sides, and horizontal feet extending outwardly from the lower end of each of the depending sides. A central aperture preferably extends through the raised horizontal center portion, and a slot preferably extends from the central aperture to one side of the raised horizontal center portion of the base, to enable the base portion to be slidably received and releasably secured beneath the first and second radial positioning members.

Another object of this invention is to secure a first set of flexibly biased, resilient spacer material near the upper end of the inner surface of the outer tubular member, and a second set of flexibly biased, resilient spacer material secured near the lower end of the outer surface of the inner tubular member, to provide a slidable, resilient, in-line slip fit between the inner and outer tubular members, enabling the inner and outer tubular members to selectively extend substantially vertically in-line for use, and to retract in-line for ease of transport or storage, using standard, commercially available tubing sizes, thereby saving the extra cost for custom slip-fit tubing.

Still another object of this invention is to provide resilient first and second horizontal bars, positioned to selectively extend in a straight, in-line, or right angle horizontal positions, or to selectively bow in selected convex, or concave horizontal positions to suit the desired configuration at assembly.

Another object of this invention is to tension the flexible sheet material at the upper end of each of the inner tubular members to avoid wrinkles caused by compression, expansion or temperature change, when the free standing modular display assembly is releasably secured in the extended position to one or more sets of first and second horizontal bars.

Still another object of this invention is to releasably secure the second horizontal bar to the respective third or fourth radial positioning members on adjacent upright sub-assemblies; while the adjacent, upright sub-assemblies are in an initial retracted position, and then to selectively raise the inner tubular member of each upright sub-assembly to a fully extended position for display; and to selectively lower the inner tubular member on adjacent upright sub-assemblies from the extended position to the retracted position, for ease of removal of the second horizontal bar from the third or fourth radial positioning members on adjacent upright sub-assemblies, without the need for tools or a ladder.

Still another object is to provide a flexible carrying case sized to contain at least three retracted, upright, free standing modular display assemblies, at least three base members, at least two horizontal bars, and at least two rolled up flexible displays, and the flexible carrying case is rolled up and releasably secured into a substantially cylindrical shape, for ease of transport and storage.

These objects and advantages will be better understood when considered together with the following specification, drawings and claims.

DESCRIPTION OF THE PREFERRED EMBODIMENTS

Figure 2A:
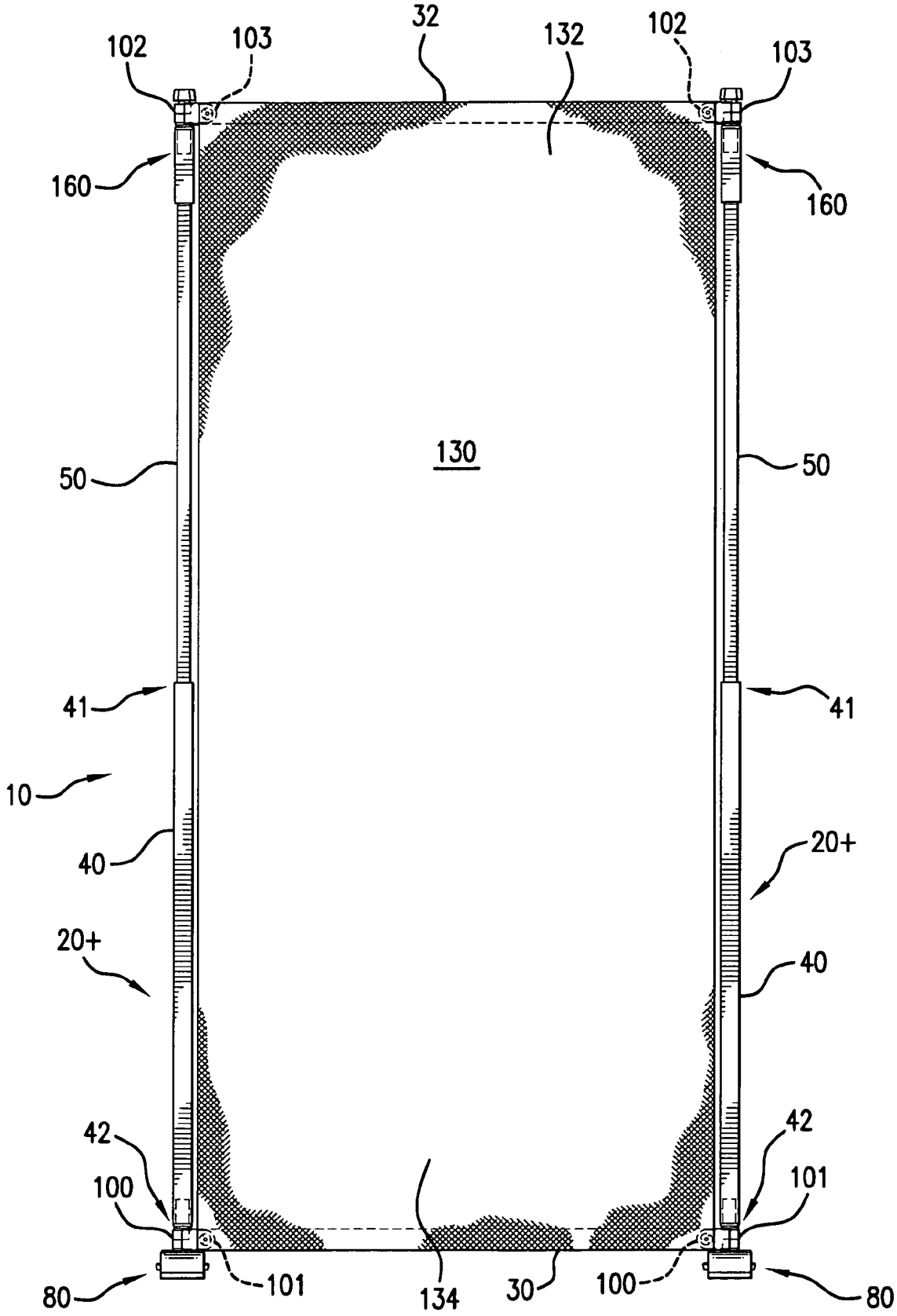
FIG. 2A is a front elevation view of two upright, free standing sub-assemblies, shown in an upright, in-line extended configuration, and joined by a set of first and second horizontal bars releasably secured near each end to the extended arms of the upper and lower radial positioning members in a substantially rectangular configuration, with the flexible display material secured to the first and second horizontal bars.

As shown in FIG. 2A, the free standing modular display assembly 10, comprises at least two upright sub-assemblies 20+ spaced apart and joined by a set of first and second horizontal bars 30, 32.

Each set of first and second horizontal bars 30, 32 preferably has a rectangular cross-section having a narrow width, and a height at least six to twelve times its width. The first horizontal bar 30 may be positioned and releasably secured in a horizontal in-line position, or may be radially, horizontally bowed between adjacent upright sub-assemblies 20+ in one of a convex 114 or concave 116 position, or alternately arranged in a right-angle 120 configuration.

One of the opposing end portions 31 of a first horizontal bar 30 is releasably secured to one of the arms 115, 117 extending from the respective first and second radial positioning members 100, 101 on the first upright sub-assembly 20+, and the opposite end portion 33 of the first horizontal bar 30 is releasably secured to one of the arms 115, 117 extending from one of the respective first and second radial positioning members 100, 101 on a second adjacent upright sub-assembly 20+. Likewise, one opposing end portion 31 of a second horizontal bar 32 is releasably secured to one of the arms 115, 117 extending from the respective third and fourth radial positioning members 102, 103 on the first upright sub-assembly 20+, and the opposite end portion 33 of the second horizontal bar 32 is releasably secured to one of the arms 115, 117 extending from one of the respective third and fourth radial positioning members 102, 103 on a second adjacent upright sub-assembly 20+. Thus, first and second upright assemblies 20+ and one set of first and second horizontal bars 30, 32 will form an upright, substantially rectangular free standing modular display assembly 10, substantially as shown in FIG. 2A.

Referring now to FIG. 1A through FIG. 9, the modular display assembly 10 disclosed herein, may be extended in length by adding additional upright sub assemblies 20+ and additional sets of first and second horizontal bars 30, 32. For example, three multiple upright sub-assemblies 20+ spaced about four feet to six feet apart may be joined by two sets of first and second horizontal bars 30, 32, to form a substantially eight foot to 12 foot free-standing modular display assembly 10, substantially as shown in FIG. 2B. Likewise, five multiple upright sub-assemblies 20+ spaced about four feet to six feet apart may be joined by four sets of first and second horizontal bars 30, 32, to form a substantially 16 foot to 24 foot modular display assembly 10, substantially as shown in FIG. 2C. The selected length of the horizontal bars 30, 32 will determine the overall length of the assembled modular display assembly 10. Of course, additional upright sub-assemblies 20+ and additional sets of first and second horizontal bars 30, 32 may be selected in length to form a modular display assembly 10 of any desired length. The first and second radial positioning members 100, 101 and the third and fourth radial positioning members 102, 103 are preferably adjustably positioned and selectively secured in one of: in-line 118; convex 114; concave 116; and right angle positions 120. This creates a free standing modular display assembly 10 having multiple in-line 118, convex 114, concave 116 or right angle 120 configurations. For example, see FIG. 5B through 5D.

The flexible display material 130 may be made of textile, fabric, vinyl, polyester, canvas, paper, plastic, or other known flexible display material 130. The display material 130 is preferably a flexible display material 130, suitable for rolling up for ease of transport or storage. The flexible display material 130 is preferably releasably secured between one or more sets of first and second horizontal bars 30, 32.

Figure 1A:
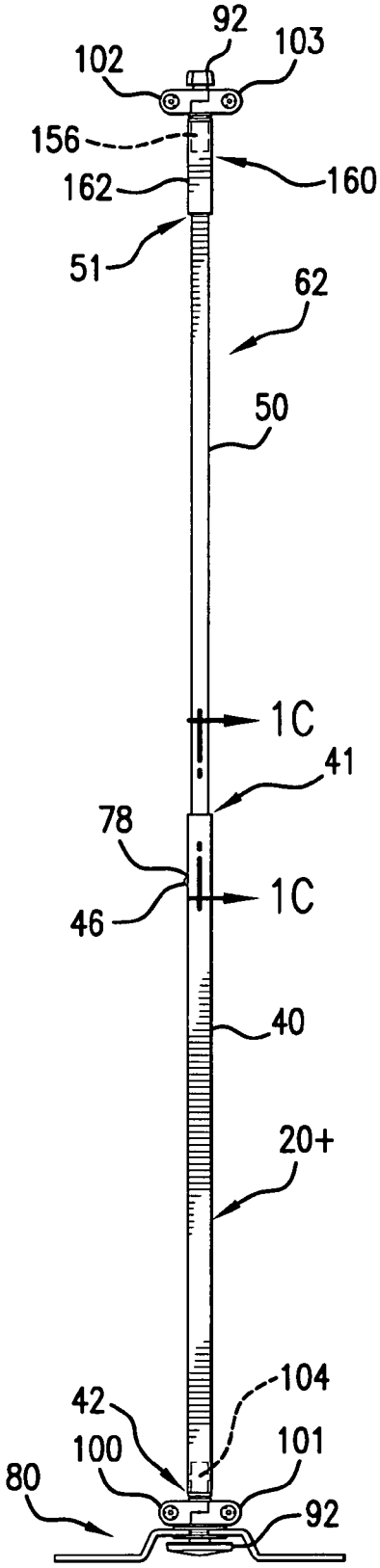
FIG. 1A is a front elevation view of one freestanding modular upright sub-assembly, shown in a fully extended vertical position.
Figure 1B:
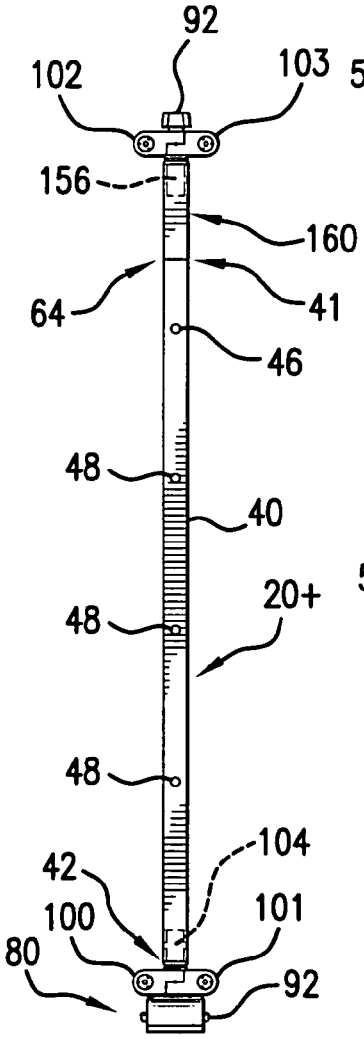
FIG. 1B is a front elevation view of one freestanding modular upright sub-assembly of FIG. 1A, shown in a fully retracted vertical position.
Figure 1C:
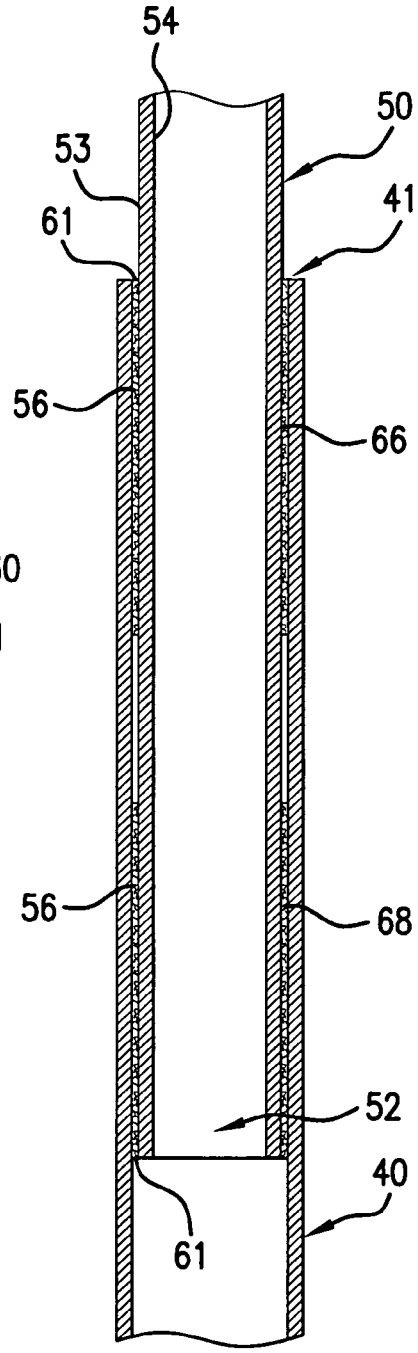
FIG. 1C is an enlarged cross-sectional view of a portion of the free standing modular upright sub-assembly of FIG. 1A, showing a first set of resilient spacers secured to the inner sides of the outer tubular member near the upper end, and a second set of resilient spacers secured to the outer sides of the inner tubular member near the lower end. The resilient spacers are sized, positioned and secured to provide a resilient, in-line slip fit between the inner and outer tubular members, and are positioned to limit the extent of travel between inner and outer tubular members in the extended position.
Figure 1D:
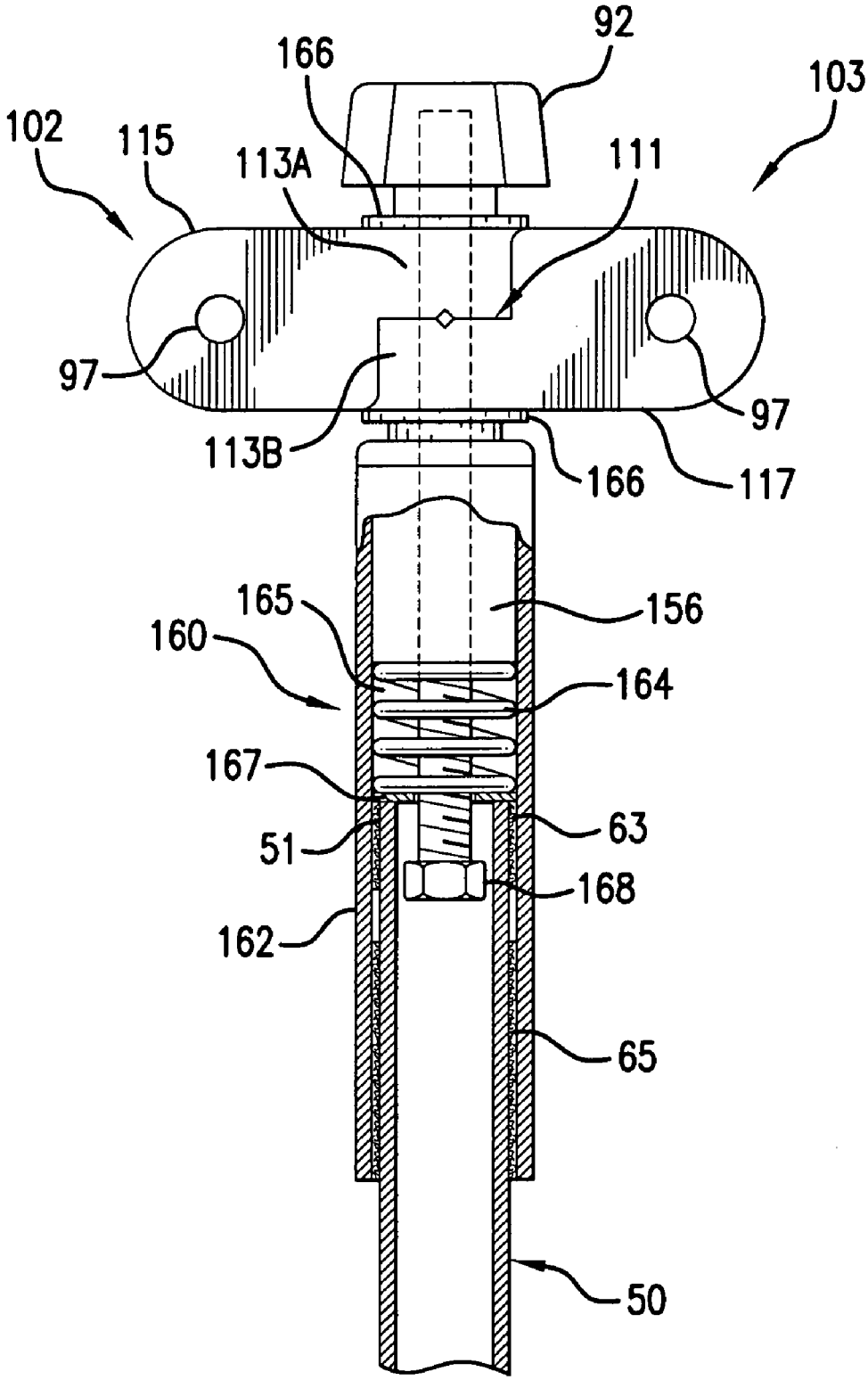
FIG. 1D is a front cross sectional view of a tensioning member assembly mounted to the upper end of the inner tubular member, to bias the second horizontal bar upwardly to lightly tension the second horizontal bar, when the flexible display material is in the extended position.
Figure 1E:
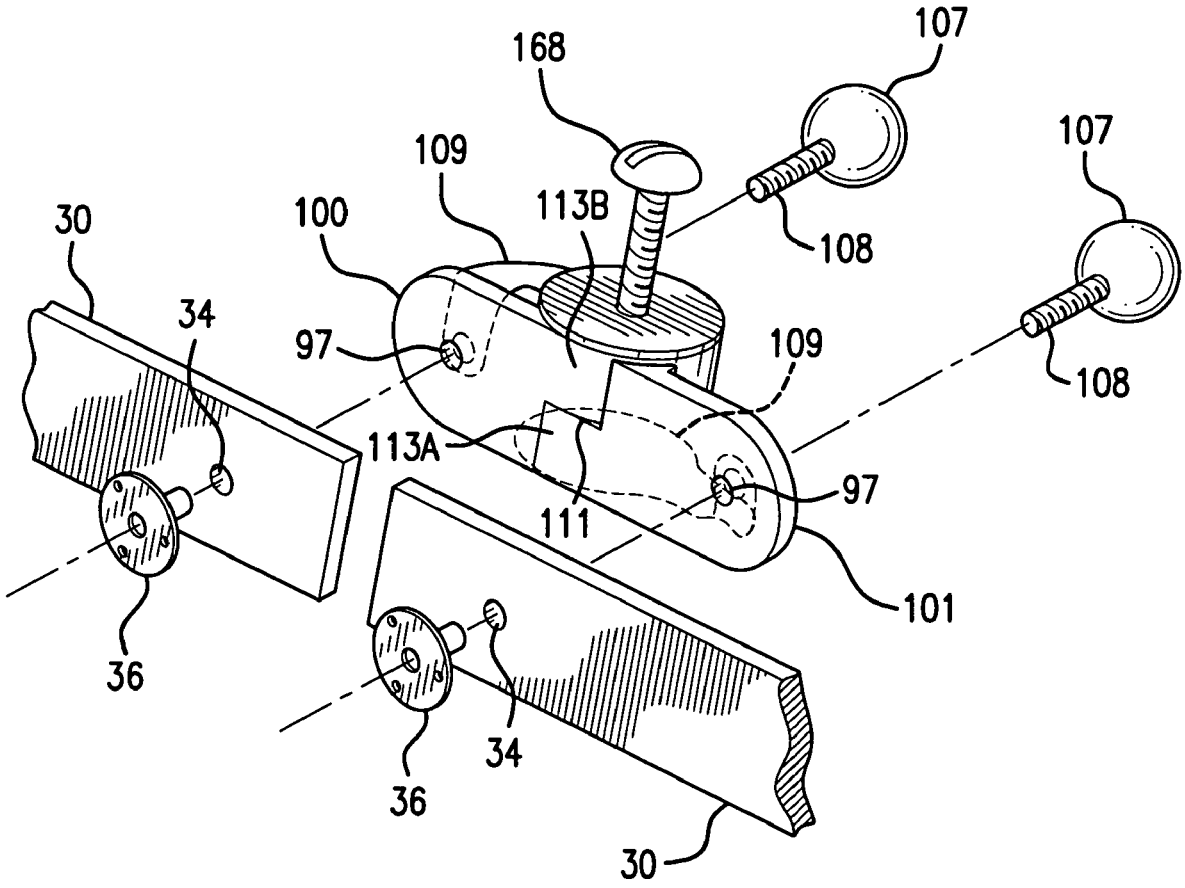
FIG. 1E is a cross sectional side view of one of the first horizontal bars releasably secured to the extended arm of the first or second radial positioning member, using a ball knob with threaded extension, which extends through an aperture in extended arm to engage a threaded aperture near one end of the first or second horizontal bar. The ball knob allows manual loosening and tightening, eliminating the need for tools during assembly. Note the use of a flexible retainer to substantially keep the ball knob in position between use, avoiding inadvertent loss.

As shown in FIG. 1E, the flexible display material 130 may be releasably secured to one of the front side and the back side of the horizontal bars 30, 32. When releasably secured to the front side, the flexible display material 130 will be free of any visible fasteners or protrusions. When releasably secured to the back side of the horizontal bars 30, 32, a suitable aperture (not shown) will be required through the flexible display material 130 in alignment with the aperture 97 in the extended arm of the first or second radial positioning member 100, 101, or the third or fourth radial positioning member 102, 103, to allow the threaded extension 108 on the ball knob 107 to threadably engage the respective T-nut 36 mounted near each end of the first and second horizontal bar 30, 32.

Any known releasable fastening means 105 may be used for releasably securing the flexible display material 130 at the lower end 134 to the first horizontal bar 32, and at the upper end 132 to the second horizontal bar 32. For example, the flexible display material 130 may be folded over and secured at the upper end 132 and/or the lower end 134, forming a pocket sized to receive the first or second horizontal bar 30, 32 there-through. Alternately, the flexible display material 130 may be secured to the first and/or second horizontal bar 30, 32 with double sided tape. Hook and loop type fastener 124 may be used to releasably secure the flexible display material 130 to the first and/or second horizontal bar 30, 32. Magnetic strip or tape 155 may also be used to secure the flexible display material 130 to the first and/or second horizontal bar 30, 32. Thus, any known commercially available releasable fastening means may be used without departing from the scope of this disclosure or from the following claims. Preferably, the flexible display material 130 is rolled up upon one of the first or second horizontal bars 30, 32 for ease of transport or storage. (See FIGS. 8A and 8B).

As shown in FIG. 1A, and FIG. 1B, each extendable upright sub-assembly 20+ preferably expands up to about six to eight feet in height, or more, and may be retracted to about three to five feet in height, for ease of transport and storage, and for ease of access during assembly. Multiple upright sub-assemblies 20+ and multiple sets of first and second horizontal bars 30, 32 may thus be selectively assembled together to form an upright, free standing modular display assembly 10 of custom length, height and configuration, to suit the needs of the user. The modular display assembly 10 disclosed herein, does not require a ladder or tools to set up or take down.

Each upright sub-assembly 20+ includes an outer tubular member 40 and an inner tubular member 50. The upright sub-assemblies 20+ are selectively manually extendable and retractable from a fully extended position 62 shown in FIG. 1A, to a fully retracted position 64 as shown in FIG. 1B, for ease of transport and storage. The inner tubular member 50 is sized to slide within outer tubular member 40 between extended 62 and retracted 64 positions.

As shown in FIG. 1C, the inner and outer tubular members 40, 50 may be sized to provide a loose fit there-between, and are preferably adapted with a first set of resilient spacers 66 secured to the inner surfaces 44 of the outer tubular member 40, near the upper end 41. A second set of resilient spacers 68 are preferably secured to the outer surfaces 53 of the inner tubular member 50 near the lower end 52. The first and second set of resilient spacers 66, 68 provide a resilient slip fit 61, between the outer surfaces 53 of the inner tubular member 50, and the inner surfaces 44 of the outer tubular member 40. The resilient slip fit 61 is preferably sized to provide a sliding light friction fit between extended 62 and retracted 64 positions, while maintaining a substantially linear alignment between the inner tubular member 50 and the outer tubular member 40. One preferred embodiment of the first and second set of resilient spacers 66, 68 is the use of either hook or loop type material 56. Preferably, the thickness of the hook or loop type material 56 is slightly greater in height than the space between the inner and outer tubular members 40, 50, resulting in partial deflection of the hook or loop type material 56. Other materials, not shown, such as felt or other known resilient material may alternately be used in place of the hook or loop type material 56 to provide the resilient slip fit 61 between the inner and outer tubular members 40, 50.

Standard tubing sizes may be used for the outer tubular member 40, such as 1 inch square tubing with 1/16 inch walls with standard tolerances. Standard tubing sizes may also be used for the inner tubular member 50, such as ¾ inch square tubing with 1/16 inch walls with standard tolerances. Of course, other sizes of tubing may be used without departing from the scope of this disclosure. The first and second sets of resilient spacers 66, 68 provide a resilient, in-line slip fit between the outer surfaces 53 of the inner tubing 50 and the inner surfaces 54 of the outer 40 tubing. This saves the cost of custom fabricated close tolerance in-line tubing, and adapts to imperfections in tubing size and fit.

The outer tubular member 40 is preferably square in cross-section. However the outer tubular member 40 may be configured to be used in other configurations, such as rectangular, circular or multi-sided, in cross-section to suit manufacturing preference. Likewise, the inner tubular member 50 is preferably square in cross-section. However the inner tubular member 50 is preferably configured to be a complimentary configuration to the outer tubular member 40, such as square, rectangular, circular, or multi-sided in cross-section, to better align and position the inner tubular member 50 in relation to the outer tubular member 40. For purposes of illustration, the inner and outer tubular members 40, 50 are shown substantially square, but rectangular, circular, or multi-sided cross-sections are also intended to fall within the scope of this disclosure and claims.

The inner and outer tubular members 40, 50 are preferably made of aluminum for strength, durability and light weight. Other tubular materials, such as plastic, fiberglass, or metal other than aluminum, etc. may alternately be used, without departing from the spirit or scope of this invention. The inner and outer tubular members 40, 50 may be anodized, painted or otherwise treated to improve appearance and increase corrosion resistance. Square or multi-sided tubing is preferred, as alignment between inner and outer tubing 40, 50 simplifies the alignment between the upper aperture 46, and additional apertures 48 in the outer tubular member 40, and the plunger aperture 72 in the inner tubular member 40.

As shown in FIG. 1D, a tensioning assembly 160 is preferably installed on the upper end portion 51 of the inner tubular member 50. In this embodiment, a short length of outer tubular material 162 of about three to twelve inches long, is slidably received over the upper end portion 51 of inner tubular member 50. An upper threaded support member 156 is secured to the upper end 41 of the outer tubular material 162, and may be welded, glued or otherwise bonded thereon. A stop washer 167 preferably rests upon the upper end 51 of the inner tubular member 50. A compression spring 164 extends between the stop washer 167 and the upper threaded support member 156, preferably forming an expandable space 165 there-between.

A threaded bolt or rod 168 extends through the stop washer 167 to engage the threads on the upper threaded support member 156. The threaded bolt or rod 168 further extends through the central aperture 96 in the third and fourth radial positioning members 102, 103 to securely engage the internal threads on a suitable threaded handle 92. The distal end of the threaded bolt or rod 168 is free to rotate in the inner tubular member 50 when the handle 92 is rotated. Washers 166 may be placed above and below the third and fourth radial positioning members 102, 103, as shown in FIG. 1D. When threaded handle 92 is manually tightened, the third and fourth radial positioning members 102, 103 are biased together to engage the boss 110 in a selected groove 112 to secure the third and fourth radial positioning member 102, 103 in a selected position. See FIGS. 4A and 4B. When threaded handle 92 is manually loosened, the third and fourth radial positioning members 102, 103 may be manually, adjustably positioned in one of at least two selected positions, preferably selected from: concave 116, convex 114, in-line 118, and right angle 120 configurations.

As shown in FIG. 1D, an upper resilient material 63 is secured to the outer surfaces 53 on the upper end 51 of the inner tubular member 50. Likewise, a lower resilient material 65 is secured to the lower end 42 of the inner surfaces 44 of the short length of outer tubular material 162, to provide a slip fit, in-line alignment there-between. The upper resilient material 63 and the lower resilient material 65 also serve to limit the travel of the short length of outer tubular material 162. Thus, a compression spring 164 acting between the upper end 51 of the inner tubular member 50 and the upper threaded support member 156 secured to the short outer tubular member 162 provides limited expansion of the expandable space 165 to ensure that the flexible display material 130 is kept in light tension and free of wrinkles, when fully extended, regardless of temperature change, humidity, etc.

FIG. 2A shows a front elevation view of two freestanding upright sub-assemblies 20+, with optional tensioning assemblies 160 attached. The radial positioning members 100, 101 and 102, 103 are joined by first and second horizontal bars 30, 32. The first and second horizontal bars 30, 32 are each releasably secured near one end 31, 33 through aperture 34 to the ball knob 107 with threaded extension 108. The threaded extension 108 passes through mounting bracket aperture 97 located through one of the extended arms 115, 117 on the first and second radial positioning members 100, 101 or 102, 103, to threadably engage T-nut 36.

Figure 3:
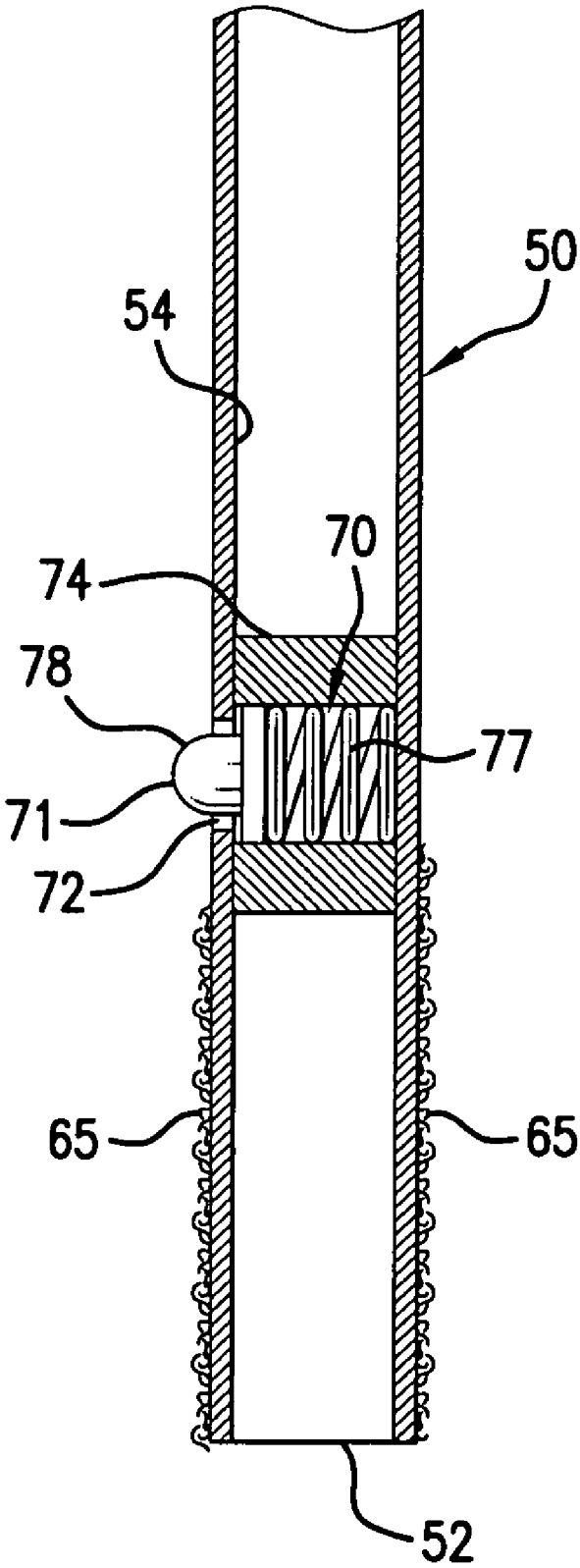
FIG. 3 is an enlarged cross section view of the plunger tip extending through the lower aperture in the lower portion of the inner tubular member, and positioned for engagement with the first upper aperture near the upper end of the outer tubular member when the inner tubular member is fully extended.

Each upright sub-assembly 20+ includes a plunger assembly 70 secured near the lower end 52 of the upper, inner tubular member 50, as best shown in cross-sectional view, in FIG. 3. Plunger assembly 70 is commercially available from numerous sources, and is selected to engage an upper aperture 46 in the outer tubular member 40 to releasably secure the raised inner tubular member 50 in relation to the outer tubular member 40 in the fully extended position shown in FIG. 1A. The plunger assembly 70, preferably extends through the plunger aperture 72 on one side of the inner tubular member 50, to engage and secure the resilient plunger end 78 within the upper aperture 46 in the outer tubular member 40.

As shown in FIG. 3, the plunger assembly 70 may be adapted with a housing 74 sized to be closely received through the plunger aperture 72 on one side of the inner tubular member 50, to ensure the plunger assembly 70 is firmly positioned in relation to the aperture 72, provided near the lower end 52 of the inner tubular member 50. The plunger assembly 70 preferably includes an internal spring 77 or biasing member 79 which biases the plunger end 78 outwardly, when aligned with the selected aperture 46 in the outer tubular member 40. This acts to releasably secure the outer tubular member 40 in relation to the inner tubular member 50 in the fully extended position shown in FIG. 1A. Any suitable commercially available releasable plunger means (not shown) may be alternately used, without departing from the spirit or scope of this disclosure, nor from the following claims.

Additional apertures 48, shown in FIG. 1B, may be positioned in spaced alignment in relation to the upper aperture 46 shown, for multiple intermediate adjustment positions, to suit user preference. Such alternate adjustment positions, are intended to fall within the scope of this disclosure and the following claims. The user manually releases the inner tubular member 50 from the outer tubular member 40 by depressing the plunger end 78 of the plunger assembly 70 extending partially beyond the selected aperture 46 in the outer tubular member 40. This allows the inner tubular member 50 to be manually, slidably biased to the next adjacent aperture 46 in the outer tubular member 40. The plunger end 78 is preferably spherically radiused, to simplify alignment, insertion and release.

Figure 4A:
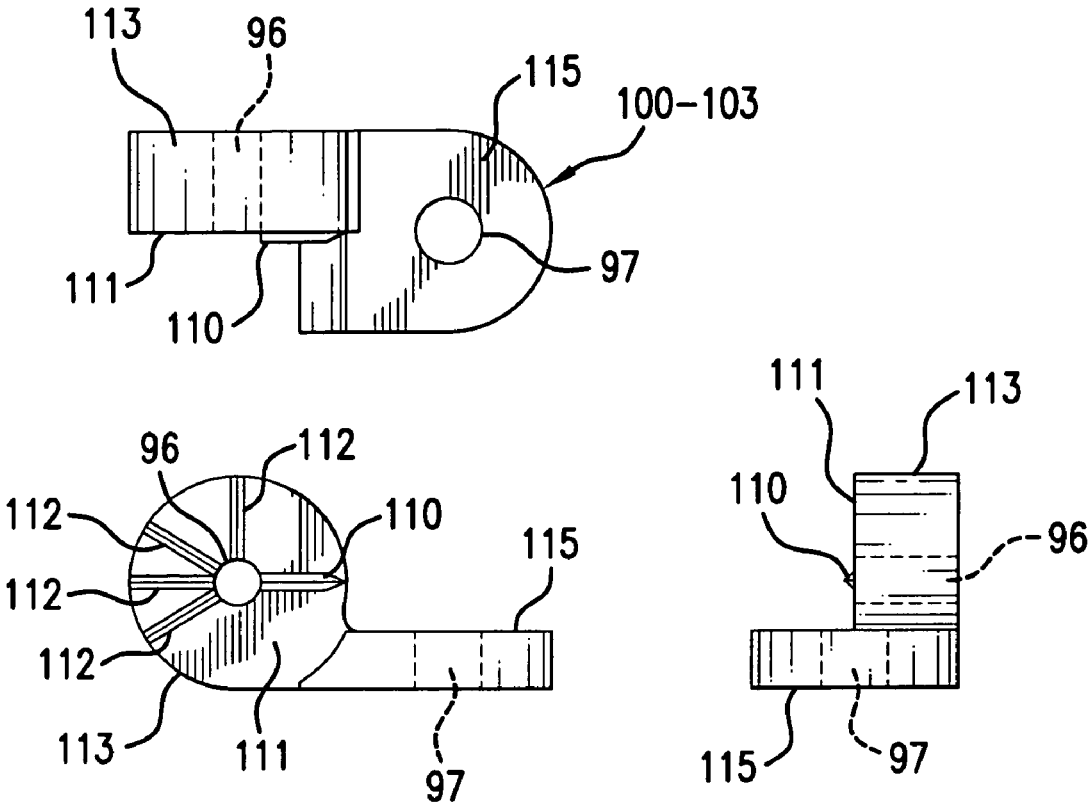
FIG. 4A is a multisided view of one of the radial positioning members, shown with a cylindrical hub and an extended arm. Note the boss and grooves used to align the radial positioning members in one of: convex, concave, in-line and 90 degree positions.
Figure 4B:
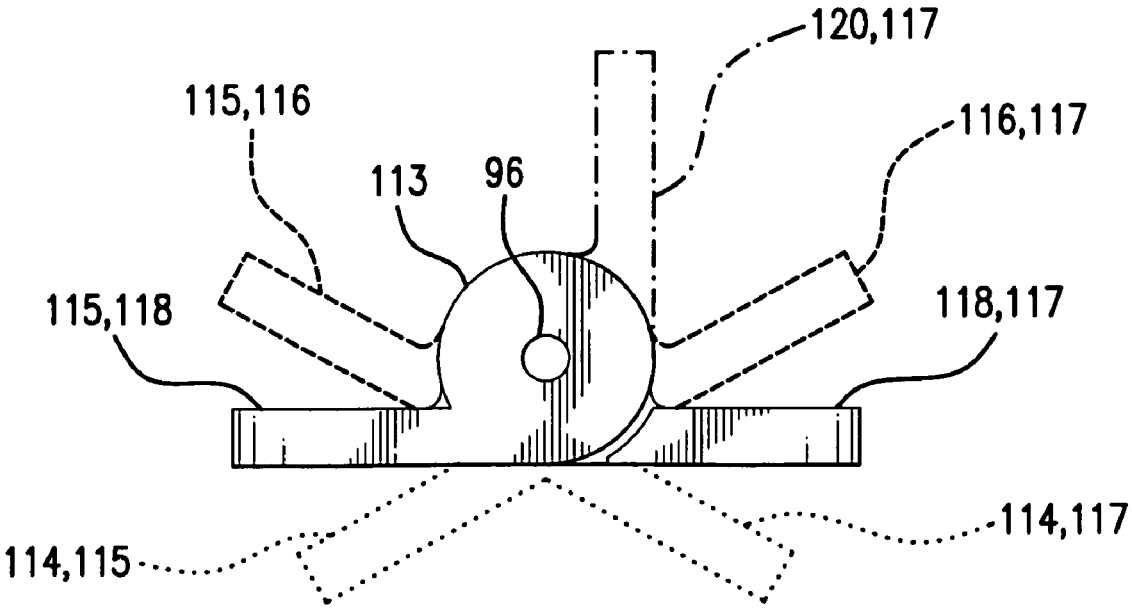
FIG. 4B is a top view of two radial positioning members, wherein the second radial positioning member is shown turned upside down to align with the central aperture in the first radial positioning member, and to engage the boss in one of the grooves in each of the first and second radial positioning members. The extended arms are shown in: a concave position in dashed line, an in-line position in solid line, a convex position in dotted line, and a ninety degree alignment position in a combination of dot and dashed lines.

Referring now to the alignment of the first and second radial positioning members 100, 101 and the third and fourth radial positioning members 102, 103, as best shown in FIGS. 4A and 4B, a boss 110 on the first side 111 of the cylindrical portion 113 of each of the first and second radial positioning members 100 and 101, will engage a selected groove 112 in the adjoining radial positioning members 100, 101, to retain their selected alignment positions. The extended arm 115 extending from the cylindrical portion 113 of the radial positioning members 100, 101, and 102, 103 may be radially positioned while the first side 111 of the upright support assemblies 20+ are assembled in adjacent spaced vertical alignment, by manually loosening threaded handle 92 and partially rotating the first and second radial positioning members 100, 101 to the desired radial position. This will allow the user to manually reposition the assembled upright assemblies 20+ without disassembling or taking down the free standing modular display 10, and requires no tools. This enables the user to easily change the look and position of the free standing modular display 10. The threaded handle 92 may be used to releasably secure the boss 110 in one of the respective grooves 112 in the radial positioning members 102, 103 in one of a selected; convex 114, concave 116, in-line 118, or right angle position 120.

FIG. 4A is a multi-sided view of one of the first and second radial positioning members 100, 101, showing an arm 115 extending from the outer circumference of the first cylindrical portion 113. At least one aperture 97 is sized to receive a suitable releasable fastening means 105 positioned to releasably secure a first or second horizontal bar 100, 101 thereon.

FIG. 4B is a top view of two radial positioning members 100, 101 or 102, 103, wherein the second radial positioning member 102 or 103 is shown turned upside down to align with the central aperture 96 in the first radial positioning member 100 or 102, and to engage the boss 110 in the first radial positioning member 100 or 102 in one of the respective grooves 112 in each of the first and second radial positioning members. The extended arms 115, 117 are shown in: a concave position 116 in dashed line, an in-line position 118 in solid line, a convex position 114 in dotted line, and a right angle alignment position 120 in a combination of dot and dashed lines. The first radial positioning member 100 is preferably designed to be turned upside down to become the second radial positioning member 101. Likewise, the third radial positioning member 102 is preferably designed to be turned upside down to become the fourth radial positioning member 103. This saves tooling expense and, reduces inventory.

As shown in FIG. 4C, a ball knob 107, with threaded extension 108, or other known releasable fastening means 105, may be used to secure the upper or lower horizontal bar 100, 101 to a selected aperture 97 in one of the extended arms 115, 117. A flexible retainer 109 may be used to keep the releasable fastening means 105 in proximity to the respective extended arm 115 when disassembled, to avoid inadvertent loss between use.

Preferably, the upper and lower radial positioning members 100, 101, and 102, 103 are similarly aligned, so that when the threaded handle 92 is manually loosened, the first and second radial positioning members 100, 101 may be selectively rotated into alternate positions, as noted above. When the threaded handle 92 is manually tightened, (no wrench or tool needed) the selected position of each of the first and second radial positioning members 100, 101 and 102, 103 are firmly releasably secured in one of convex 114, concave 116, in-line 118, or right angle 120 positions. An optional cord, line, rope, strap or bar 122, may be tensioned and releasably secured between adjacent upright sub-assemblies 20+ to aid in retaining the first and second horizontal bars 30, 32 into the selected concave 116 or convex 114 positions at assembly. See FIGS. 5B, 5C and 5D for examples.

Preferably, a threaded T-nut 36 or other known threaded fastener is secured in the aperture 34 provided near the ends of the first or second horizontal bar 30, 32. The threaded T-nut 36 may be spot welded, soldered, or glued in the aperture 34 provided in the first or second horizontal bar 30, 32. A threaded screw (not shown) may be sized to pass through the aperture 97 in one of the extended arm(s) 115, 117 to threadably engage the T-nut 36 secured in aperture 34 located near the end of the selected first or second horizontal bar 30, 32. Alternately, the T-nut 36 may be replaced with any known threaded insert (not shown) in place of aperture 34 located near the ends of the horizontal bars 30, 32.

Figure 5A:
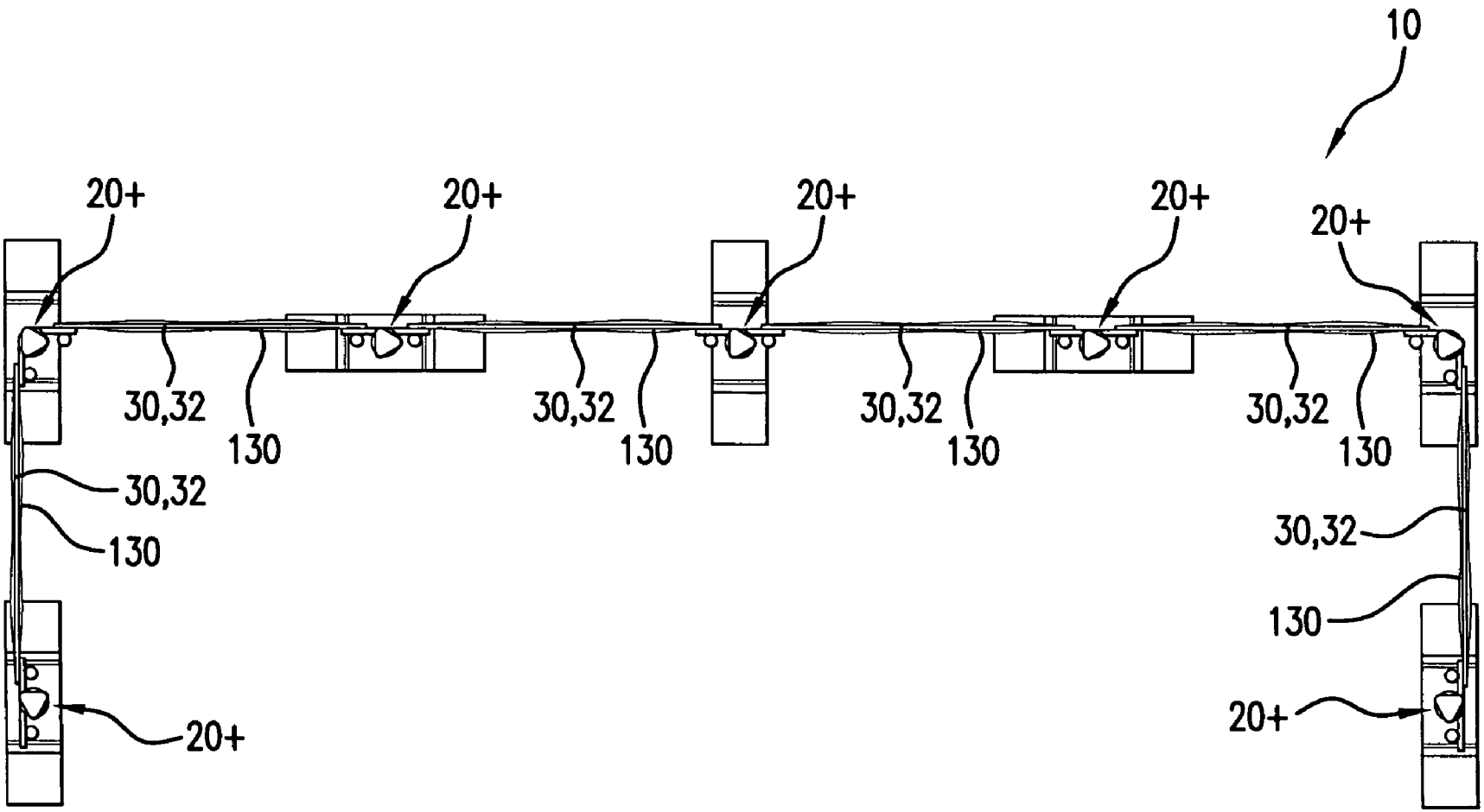
FIG. 5A is a top view of five free standing upright sub-assemblies, with four sets of first and second horizontal bars, shown in a repetitive in-line configuration, with the extended arms of the first and fifth radial positioning members positioned at right angles, and additional horizontal bars extending to two additional sets of free standing upright sub-assemblies, forming right angle end configurations.

FIG. 5A is a top view of seven free standing upright sub-assemblies 20+ with the first free standing upright assembly 20+ configured at right angles to the second. The third. fourth, fifth and sixth free standing upright sub-assemblies 20+, are preferably positioned in-line 118. The seventh free standing upright assembly 20+ is positioned at right angles to the sixth free standing upright sub-assembly 20+. First and second horizontal bars 30, 32 extend to connect with the respective radial positioning members 100, 101, 102, 103 on the second through sixth upright sub-assemblies 20+, forming an inline 118 assembly, with the first free standing upright assembly 20+ at right angles 120 to the second free standing upright assembly 20+ and the seventh free standing upright assembly 20+ at right angles to the sixth free standing upright assembly 20+.

Figure 5B:
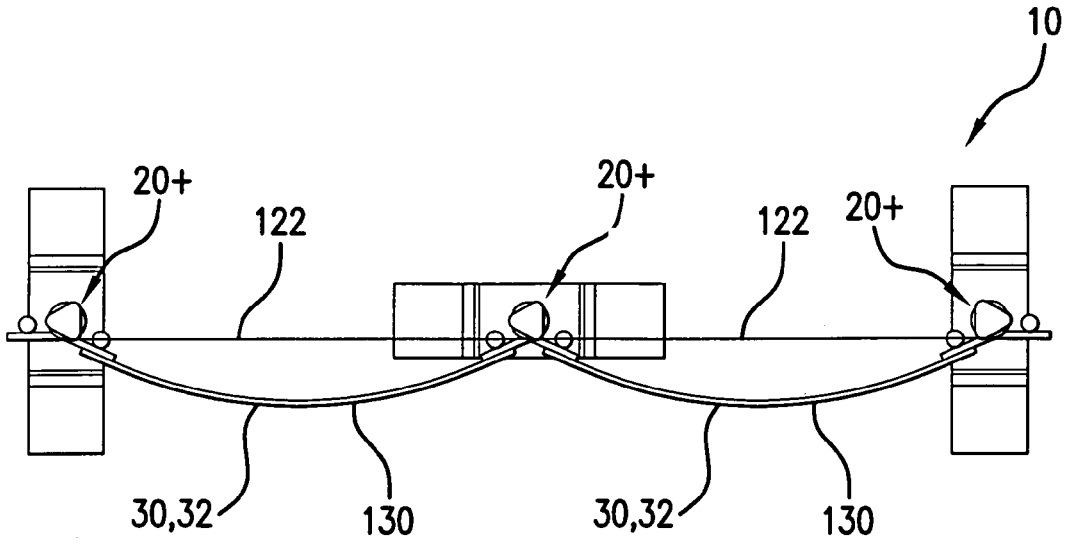
FIG. 5B is a top view of three free standing upright sub-assemblies, with two sets of first and second horizontal bars, shown in a bowed, horizontal, repetitive convex, gull wing configuration.

FIG. 5B is a top view of three free standing upright sub-assemblies 20+, with two sets of first and second horizontal bars 30, 32, shown in a repetitive convex, gull wing configuration. The respective radial positioning members 100, 101 and 102, 103 are adjustably positioned and releasably secured in convex 114 alignment, and the first and second sets of horizontal bars 30, 32 are convexly bowed. Note the optional use of line, cord, rope, strap or bar 122 positioned between adjacent spaced upright sub-assemblies 20+ to aid in maintaining a convex 114 configuration during assembly.

Figure 5C:
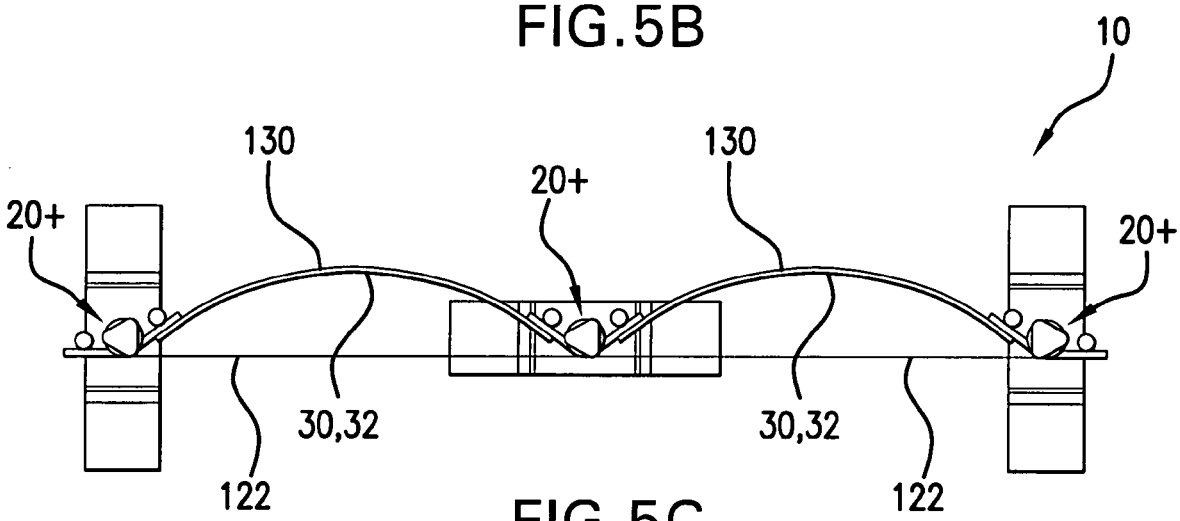
FIG. 5C is a top view of three free standing modular upright sub-assemblies, with two sets of first and second horizontal bars, shown in a bowed, horizontal, repetitive concave configuration.

FIG. 5C is a top view of three free standing upright sub-assemblies 20+, with two sets of first and second horizontal bars 30, 32, shown in a repetitive concave 116 configuration.

The respective radial positioning members 100, 101 and 102, 103 are adjustably positioned and releasably secured in concave 116 alignment, and the first and second horizontal bars 30, 32 are concavely bowed. Note the optional use of line, cord, rope, strap or bar 122 positioned between adjacent spaced upright sub-assemblies 20+ to aid in maintaining a concave 116 configuration, during assembly.

Figure 5D:
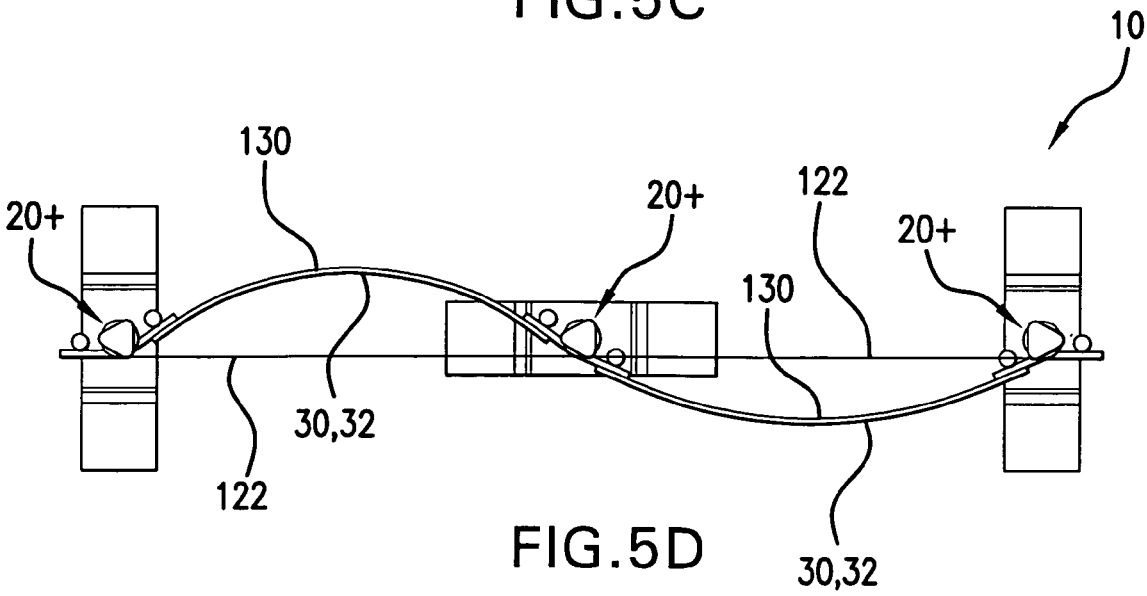
FIG. 5D is a top view of three free standing upright sub-assemblies, with two sets of first and second horizontal bars, shown in a bowed, horizontal, concave-convex, serpentine configuration.

FIG. 5D is a top view of three free standing upright sub-assemblies 20+, with two sets of first and second horizontal bars 30, 32, shown in alternating concave 116, convex 114, serpentine configuration. In this embodiment, the radial positioning members 100, 101 on the first free standing upright sub-assembly 20+ are adjustably positioned and releasably secured in a concave 116 alignment. The respective radial positioning members 100, 101 and 102, 103 on the second free standing upright sub-assembly 20+ are adjustably positioned and releasably secured in an in-line 118 alignment and the respective radial positioning members 100, 101 and 102, 103 on the third free standing upright sub-assembly 20+ are adjustably positioned and releasably secured in a convex 114 alignment. A first set of horizontal bars 30, 32 are secured to the respective radial positioning members 100, 101 and 102, 103 and bowed in a concave configuration. The second set of horizontal bars 30, 32 are secured to respective radial positioning members and bowed in a convex 114 configuration, to create a serpentine configuration. Note the optional use of line, cord, rope, strap or bar 122 positioned between adjacent spaced upright sub-assemblies 20+ to aid in maintaining a concave 116, convex 114, serpentine configuration.

Figure 6:
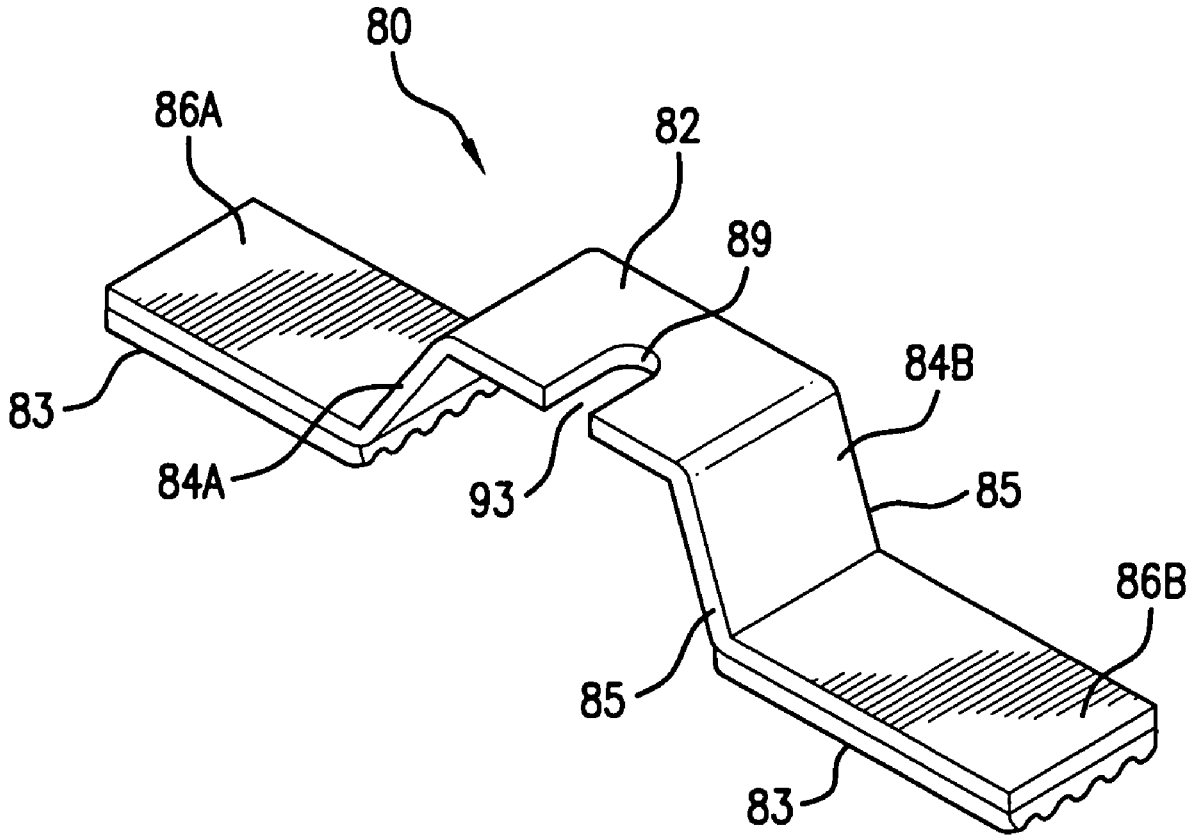
FIG. 6 is a perspective view of a preferred elongated base member, with a horizontal raised top portion, with depending side portions on each end of the raised top portion, and with substantially horizontal feet extending outwardly from each of the depending side portions. Note the central aperture extending through the horizontal raised top portion, with a slot preferably extending from the aperture to one side of the horizontal raised top portion.

Referring now to FIG. 6, an elongated base member 80 preferably comprises a raised horizontal center portion 82 with opposing sides 85. A suitable aperture 89 is preferably centered on the raised horizontal center portion 82. A slot 93 preferably extends from the center aperture 89 to one of the sides 85. Inclined, depending portions 84 are located on opposing ends of the horizontal center portion 82. Horizontal feet 86 extend from the lower end of each of the depending portions 84, in parallel alignment with the raised horizontal center portion 82, to provide horizontal supporting surfaces 87, 88 for positioning and supporting each upright assembly 20+ in substantially vertical alignment. The raised horizontal center portion 82 preferably provides clearance for a threaded handle 92 positioned beneath the raised center portion 82. The threaded handle 92 allows the user to selectively loosen or tighten the radial positioning members 100, 101 to selectively adjust and releasably secure the first and second radial positioning members 100, 101, as previously noted, without taking down the free standing modular display assembly 10. The threaded handle 92 may be hand tightened and releasably secured, without the aid of hand or power tools.

The lower horizontal supporting surfaces 87, 88 of the horizontal feet 86 may optionally be coated or covered with a slip resistant material 83, such as rubber, felt, abrasive coated tape, abrasive paint, or other slip resistant material. Alternately, any previously known, suitable slip resistant material 83 may be used, and such use is intended to fall within the scope of this disclosure and claims.

The base member 80 may be formed, cast, molded, or machined, as shown in FIG. 6. The slot 93 is preferably sized to slidably receive a resilient spacer 94 loosely received on a threaded bolt 90. Large washers 95 are positioned above and below the resilient spacer 94 and the raised, horizontal center portion 82. When the slot 93 on the base member 80 is positioned about the resilient spacer 94, between the large washers 95, the handle 92 secured to one end of the bolt 90 is then hand tightened, to compress the resilient spacer 94. This tightens the large washers 95 against the upper and lower surfaces of the raised horizontal center portion 82, releasably securing the base member 80 to the upright sub-assembly 20+. When the handle 92 is manually loosened, the resilient spacer 94 expands, to allow the slot 93 in the raised horizontal center portion 82 in the base member 80 to be easily inserted or removed from the upright sub-assembly 20+, without dismantling the entire upright sub-assembly 20+. Removal of the base member 80 allows for more compact transport and storage of the free standing modular display assembly 10, while providing easy set up and take down.

Figure 7:
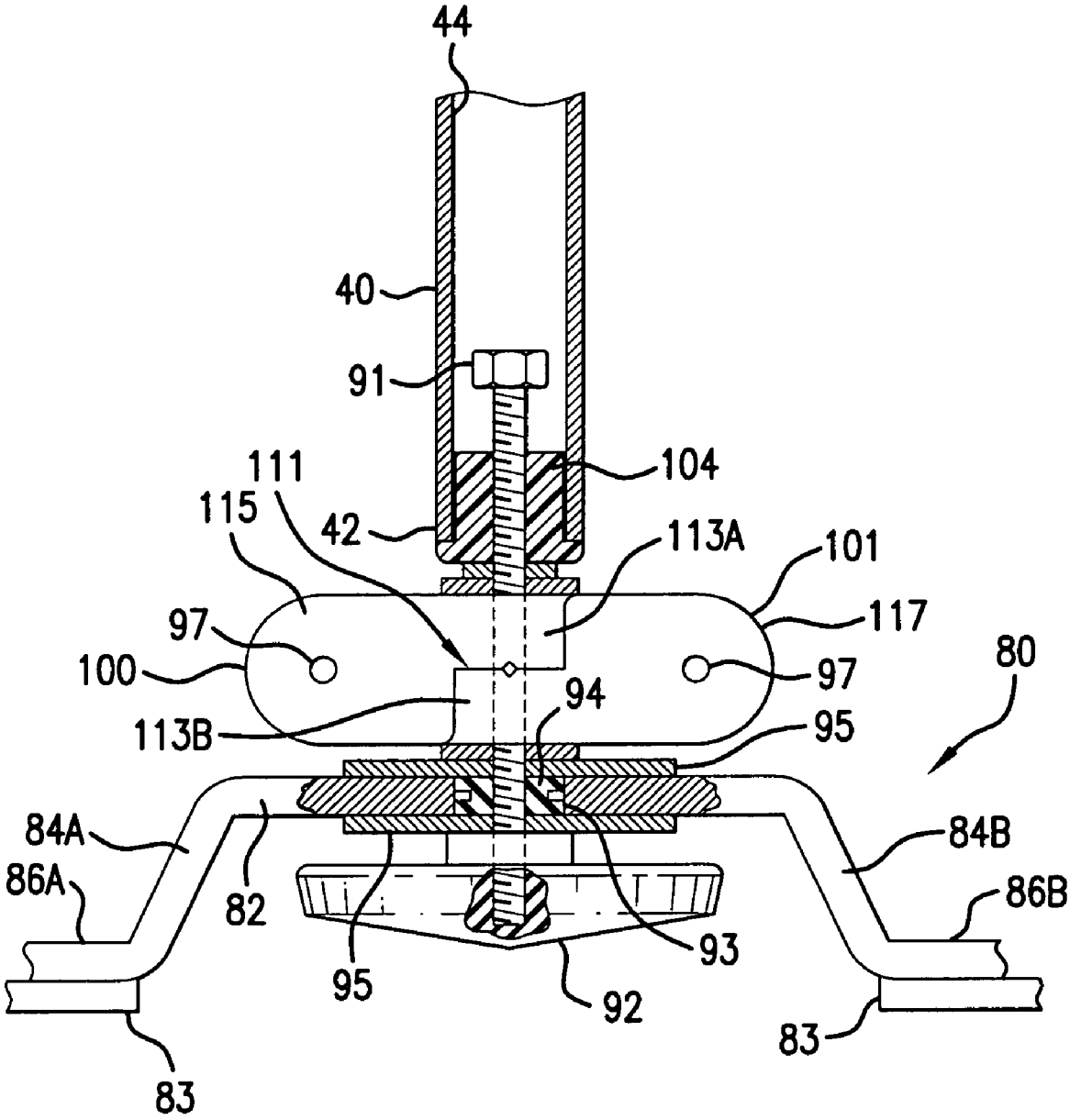
FIG. 7 is a partial front view of the removable base member with the first and second radial positioning members releasably secured between the mounting bracket and the lower threaded support member. The first and second cylindrical portions of the respective first and second radial positioning members are biased by a resilient spacer. The resilient spacer is sized to closely receive the threaded bolt between the upper and lower hubs. A knob or handle is secured to the threaded bolt beneath the lower hub to selectively manually tighten or loosen the threaded bolt. When the threaded bolt is loosened, the resilient spacer expands, allowing the removable base member to be easily manually inserted or removed. When the threaded bolt is tightened, the resilient spacer is compressed, and the removable base member is tightened to resist removal during use.

As best shown in FIG. 7, a threaded bolt 91 extends through the lower threaded support member 104, the central aperture 96 in the first and second radial positioning members 100, 101, through the central aperture 89 in the base member 80, through the resilient spacer 94 positioned in the central aperture 89, and through the large washers 95 located on each side of the raised horizontal center portion 82. The threaded bolt then extends into a threaded aperture in the handle 92, where it is suitably secured upon initial assembly. The threaded bolt 91 has a bolt head positioned above the lower threaded insert 104 sufficient to allow limited travel of the bolt 91 above the lower threaded insert 104. This allows manual rotation of the threaded handle to loosen or tighten the first and second radial positioning member 100, 101, but restricts inadvertent removal of the threaded bolt 91 from the assembly shown in FIG. 7 during use. The threaded handle 92 may be selectively loosened, to provide adjustment of the radial positioning members 100, 101 between one of: inline 118, convex 114, concave 116 and right angle 120 positions. When the threaded handle 92 is manually tightened, the resilient spacer 94 is compressed, to firmly secure the base member 80 in a selected position between the large washers 95.

Figure 8:
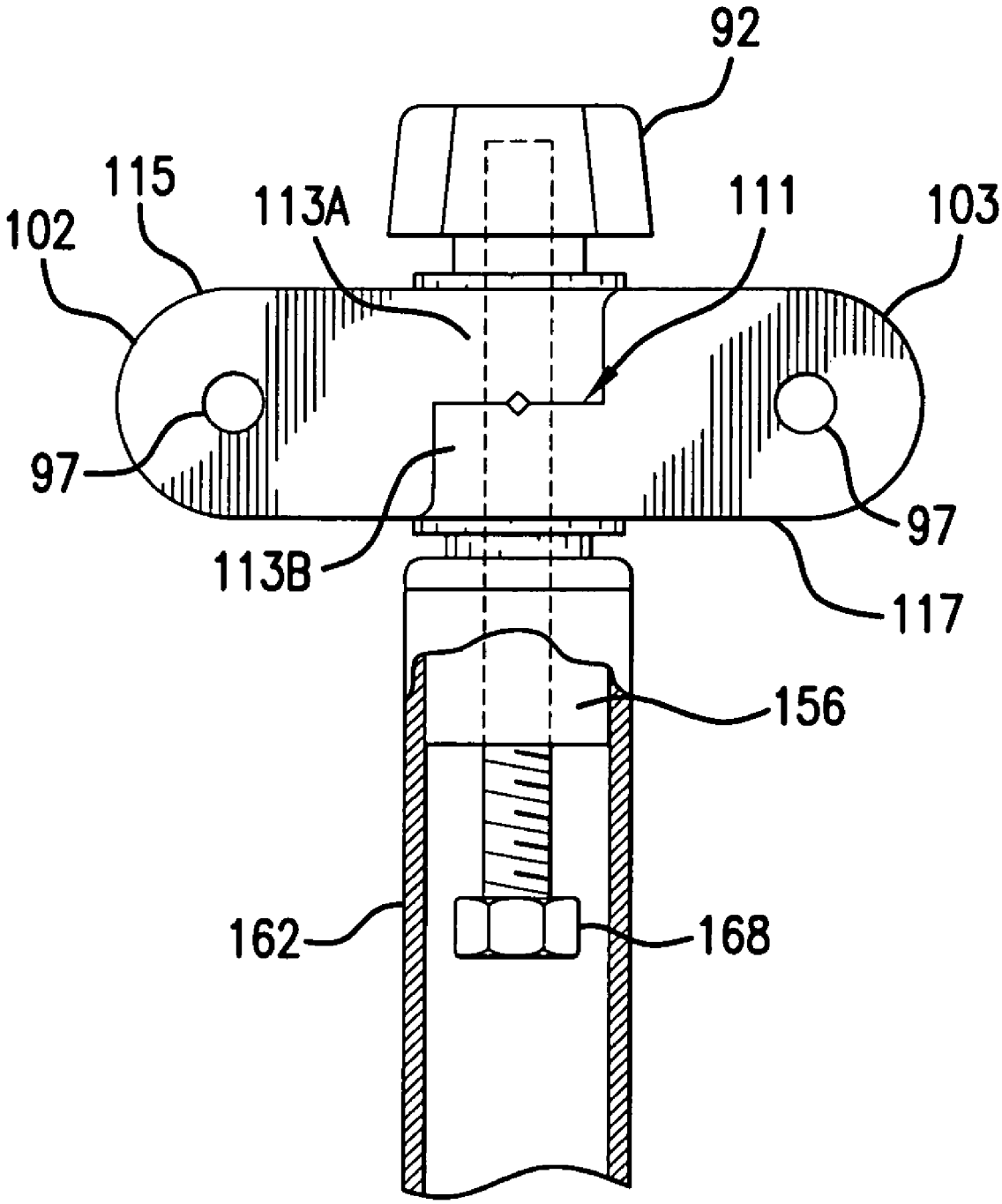
FIG. 8 is a partial front view of the third and fourth radial positioning members secured between the upper threaded support member and the threaded handle, when the tensioning assembly is not used. (See FIG. 1D, for details of the tensioning assembly).

FIG. 8 is a partial front elevation view of the third and fourth radial positioning members 102, 103, which are positioned between the upper threaded support member 156 located at the upper end portion 51 of the inner tubular member 50 and the threaded handle 92. The threaded bolt 168 threadably engages the upper threaded insert 156, and extends through the third and fourth radial positioning members 102, 103 to threadably engage the threaded handle 92, where it is secured at initial assembly. The threaded bolt 168 has a bolt head positioned below the upper threaded insert 156 sufficient to allow limited travel of the bolt head 91 below the upper threaded insert 156. This allows manual rotation of the threaded handle 92 to loosen or tighten the first and second radial positioning member 102, 103, but restricts inadvertent removal of the threaded bolt 168 from the assembly shown in FIG. 8, during use.

The threaded handle 92 may be selectively loosened, to provide adjustment of the radial positioning members 102, 103 between one of: inline 118, convex 114, concave 116 and right angle 120 positions. When the threaded handle 92 is manually tightened, the boss 110 on the third radial positioning member 102 firmly engages the selected groove 112 in the fourth radial positioning member 103, while the boss on the fourth radial positioning member 103 firmly engages a corresponding groove 112 in the third radial positioning member 102, to firmly secure the radial positioning member 102, 103 in a selected position, as shown in FIGS. 4A and 4B. Alternately, the tensioning assembly 160 shown in FIG. 1D may be used.

Figure 8A:
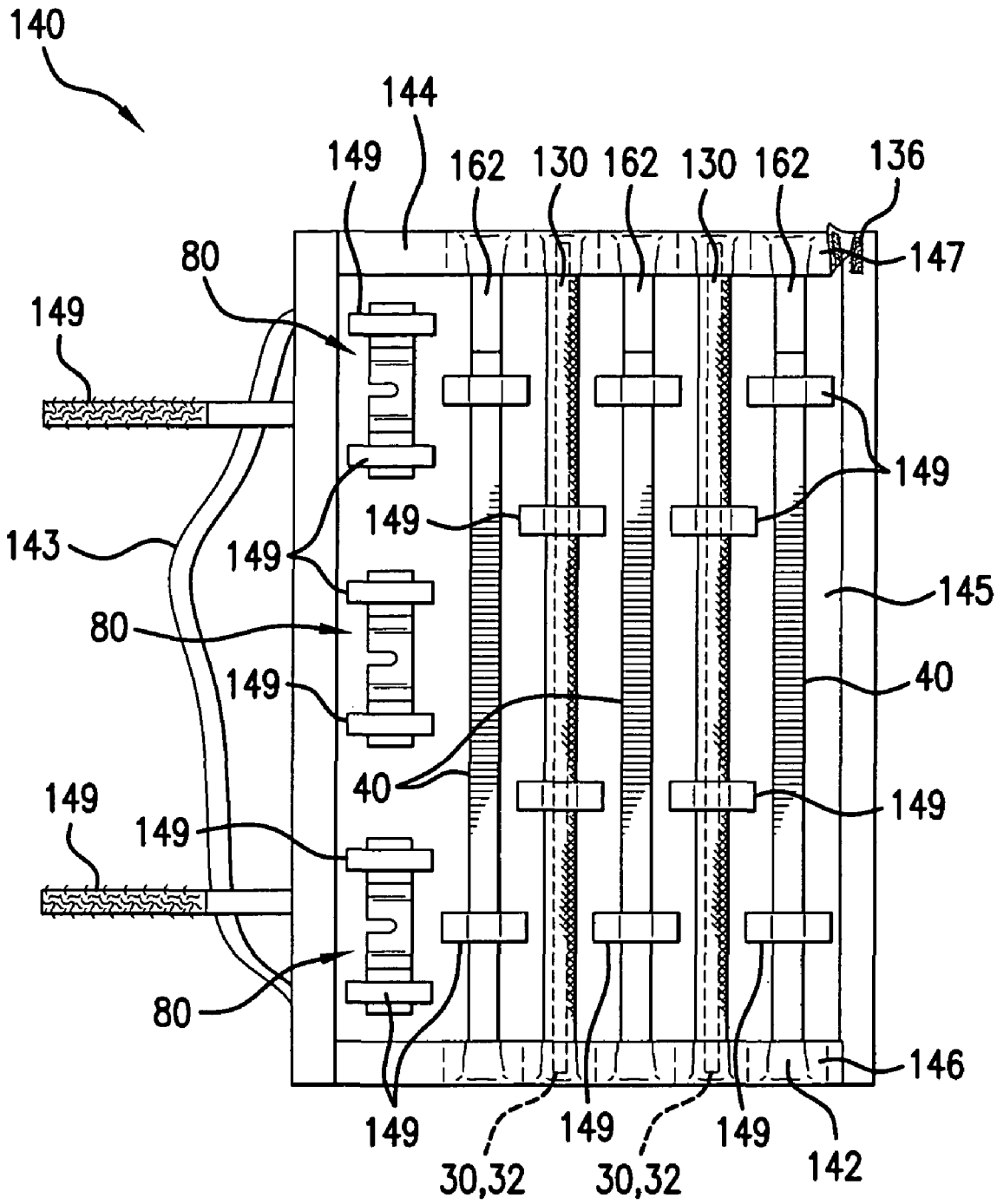
FIGS. 8A and 8B is an open view of a flexible carrying case with the component parts of the free standing modular display assembly positioned thereon.

As shown in FIG. 8A, a flexible carrying case 140 is preferably used to contain and carry the component parts of the free standing modular display assembly 10, for ease of transport or storage. The flexible carrying case 140 may be laid open, to insert the component parts of the free standing modular display assembly 10 in upper and lower pockets 146, 147 provided, including upright sub-assemblies 20+ with base members 80 removed and separately stored therein, as well as first and second horizontal bars 30,32, with flexible display material 130 rolled up thereon. Upper and lower pockets 146, 147 are preferably releasably secured 148 to the backing material 145 used in the flexible carrying case 140, for ease of insertion and removal of the component parts of the free standing modular display 10. Hook and loop type fasteners, or other known releasable fastening means 136, such as snaps, hooks, clasps, etc. (not shown) may be alternately used. At least one of the upper and lower pockets 146, 147 may be fixedly secured to the backing material 145, such as by sewing, stitching, gluing, etc.

Figure 8B:
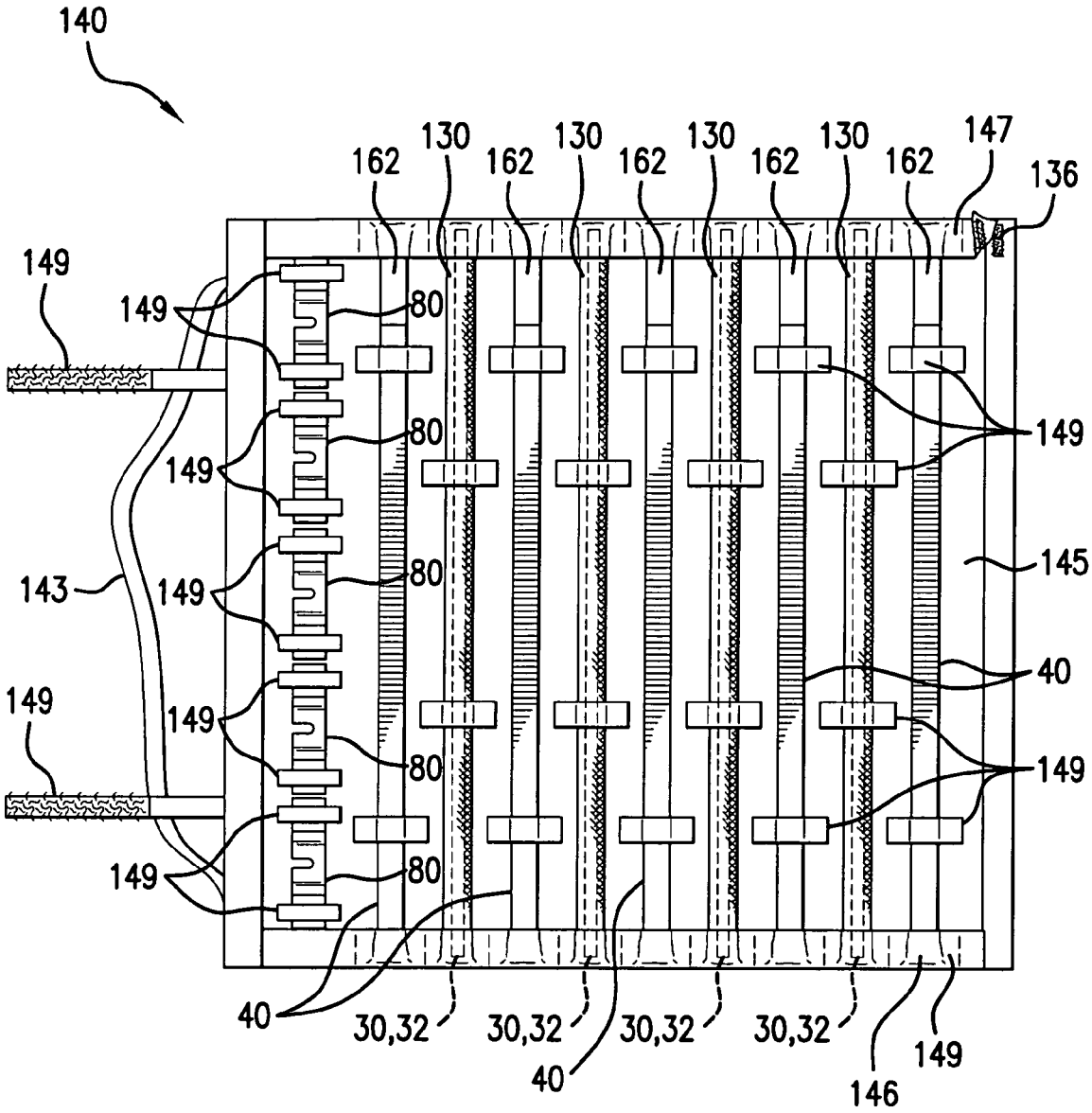

The flexible carrying case 140 is rolled up and preferably secured with one or more suitable straps 149. Alternately, any known securing means, such as a latch, catch, snaps, hooks, button, etc. may be used. A handle 141 and/or shoulder strap 143 is preferably secured to the backing material 145, for ease of transport. The flexible carrying case 140, shown in FIG. 8A, is preferably sized to carry an eight to twelve foot long free standing modular display assembly. By extending the length of the flexible carrying case, as shown in FIG. 8B, additional upright sub-assemblies, and additional horizontal bars with flexible display material rolled thereon, as well as additional base members may be added to carry longer lengths of free standing modular display assembly 10.

Figure 9:
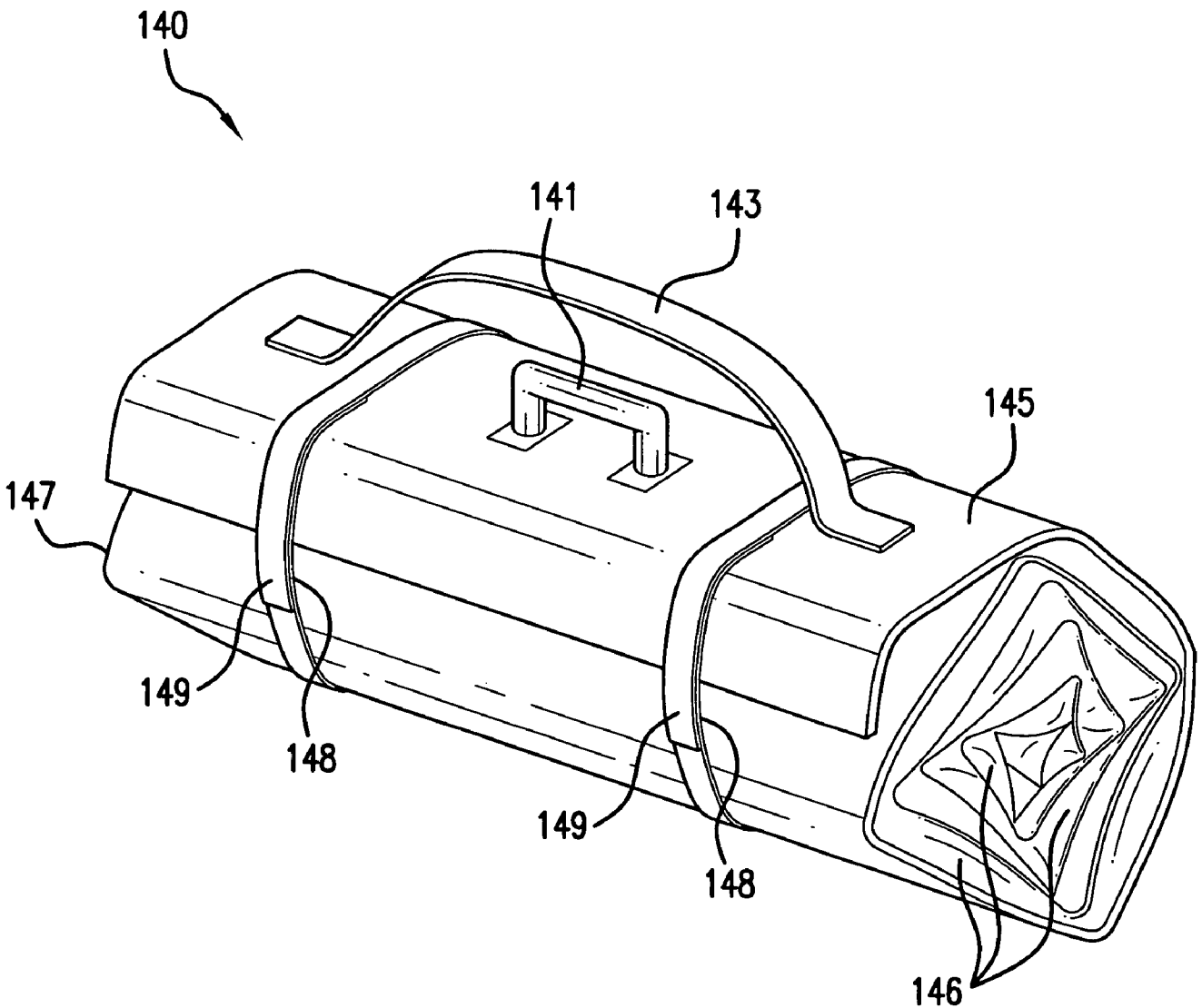
FIG. 9 is a perspective view of the flexible carrying case rolled up and releasably secured for ease of transport or storage.

FIG. 9 shows a perspective view of the rolled up flexible carrying case 140. Optional wheels (not shown) may be provided at one end of the flexible carrying case 140. However, due to the compact size and weight, the flexible carrying case 140 may be easily manually carried or transported to and from the tradeshow or event by one person. Due to its compact size and weight, the carrying case 140 may be carried onboard a car, train, plane or boat, or shipped by carrier, to and from a tradeshow or other event at a fraction of the cost of a rigid backdrop or display.

Thus, it should be obvious to one of average skill in this art, given the explanation and Figures provided herein, that any combination of convex 114, concave 116, in-line 118, and right angle 120 configurations may be easily provided by adjusting the respective radial positioning members 100, 101, and 102, 103, on the respective upright sub-assemblies 20+. It should also be apparent that any number of upright sub-assemblies 20+ with first and second horizontal bars 30, 32 may be adapted for use, to expand the length of the display to suit any desirable size.

It is further noted, that any configuration may be easily changed from any one of the combinations disclosed herein, to any other combination simply by loosening each of the handles 92, used to releasably secure the first and second radial positioning member 100, 101 and the third and fourth radial positioning member 102, 103; then changing the position of the first and second radial positioning members 100. 101 and 102, 103 and releasably securing the respective handles 92 to secure the first and second radial positioning member 100, 101 and third and fourth radial positioning member 102, 103 in the newly desired position. This may be done without dismantling the modular display assembly 10. Thus, each day of a tradeshow, the free standing modular display 10 may be re-configured in minutes, in a variety of in-line, convex, concave and right angle positions, to create a new look, with little time or effort, and without disassembling the free standing modular display assembly 10.

To assemble the modular display assembly 10, the user first removes the upright sub-assemblies 20+ from the flexible carrying case 140, and assembles the base member 80 to a respective upright sub-assembly 20+ as shown in FIG. 6B. The upright sub-assemblies 20+ are then spaced about four to six feet apart in their retracted positions shown in FIG. 1B. The first horizontal bar(s) 30, are releasably secured near each end with a releasable fastening means 136 to the first and second radial positioning members 100, 101 located above the base member 80. The second horizontal bar(s) 32 are releasably secured near each end with a releasable fastening means 136 to the third and fourth radial positioning members 102, 103, while the upright sub-assembly 20+ is in a retracted position 64. The flexible display material 130 may be already secured to the respective first or second horizontal bars 30, 32, or releasably secured by any known means, including hook and loop type fasteners, magnetic fasteners, tape, glue, etc. The inner tubular member(s) 50 may then be raised in height to the extended position, and secured by the plunger assembly 70. The plunger assembly 150 is positioned to releasably secure each upright sub-assembly 20+ in the fully extended position. The inner tubular member 40 may be raised in increments, by one person without requiring a ladder or hand or power tools.

Figure 2B:
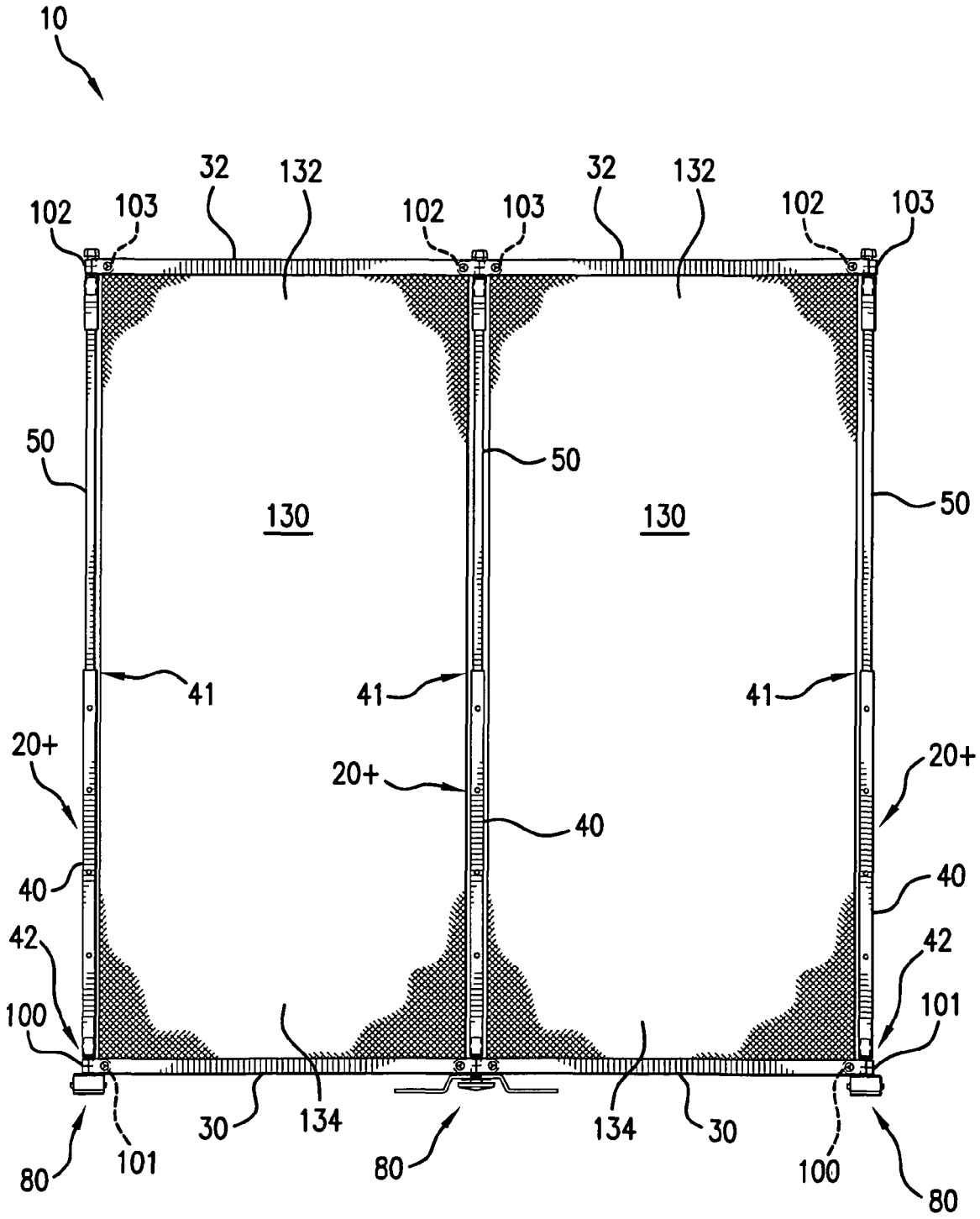
FIG. 2B is a back elevation view of three upright sub-assemblies, joined by two sets of first and second horizontal bars. The upright sub-assemblies are positioned in an extended, in-line configuration, with flexible display material attached to respective sets of first and second horizontal bars.
Figure 2C:
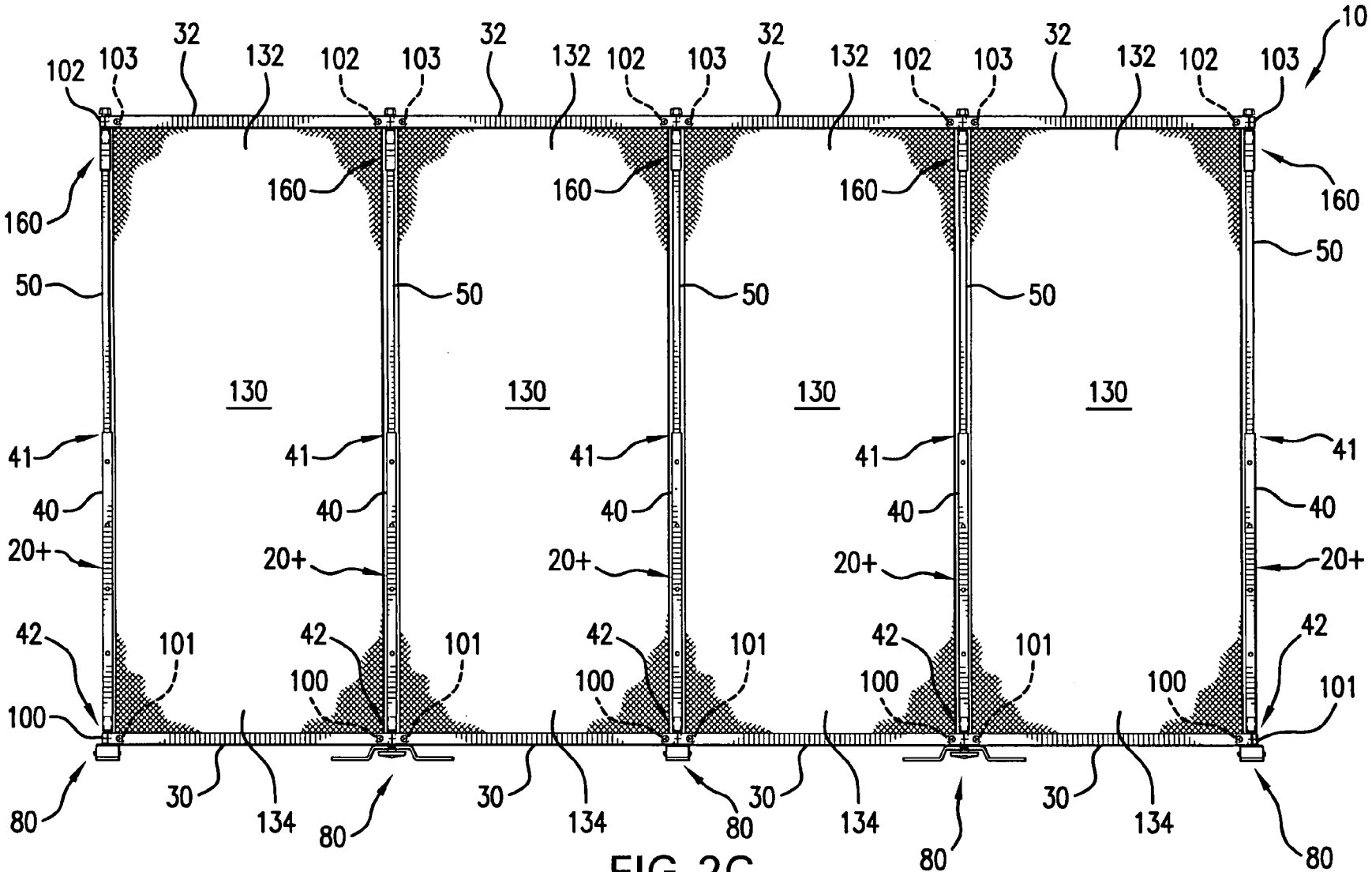
FIG. 2C is a back elevation view of five inline, free standing upright sub-assemblies, and joined by four sets of first and second horizontal mounting bars, with flexible display material attached to respective sets of first and second horizontal bars.

The flexible display material 130 is drawn taunt in the extended position, by extending each of the upright sub-assemblies 20+ as shown in FIGS. 2A, 2B and 2C. Where used, the tensioning assembly 160 draws taunt the flexible display material 130, as best shown in FIG. 1D.

Upon completion of the tradeshow, the modular display assembly 10 may be easily disassembled by retracting the inner tubular member 50 to the position shown in FIG. 1B. That will position the second horizontal bar 32 at about chest height, for ease of disconnecting the first and second horizontal bars 30, 32 from the modular display 20+, without the need for a ladder. Once the upper and lower horizontal bars 30, 32 have been removed from the upright sub-assemblies 20, the flexible display material 130 may be easily rolled up upon at least one of the upper or lower horizontal bars 30, 32. An optional slotted tube 38 may be positioned over one of the first and second horizontal bars 30, 32, and used to roll up the flexible display material 130 thereon, without creases or wrinkles.

The base member 80 may then be removed from the lower end portion 42 of the outer tubular member 40, and placed into suitable straps 149 in the carrying case 140, along with the upright sub-assembly 20+ and the first and second horizontal bars 30, 32, for ease of transport or storage. Alternately, the base member 80 may be retained on each of the upright sub-assemblies 20+, and stored in the transport container 140 together with the upright sub-assembly 20. This option requires a larger diameter carrying case 140.

As shown in FIG. 8A, the flexible carrying case 140 is preferably sized to contain all the component parts required for an eight to twelve foot long display. The flexible carrying case 140 may be adapted with a carrying handle 141, and/or a shoulder strap 143. One or more straps 149 may be used to releasably secure the rolled up flexible carrying case 140. One or more wheels (not shown) may be optionally mounted on opposing sides or ends of the carrying case 140, for ease of transport. As shown in FIG. 8B, the carrying case 140 may alternately be lengthened for carrying a twelve to eighteen foot display, an eighteen foot to 24 foot display, a 24 foot to 36 foot display, or a 36 foot or longer display.

Thus, while the preferred embodiment of the free standing modular display assembly 10 has been disclosed herein, many modifications and adaptations may be made to this invention, and it is intended that such modifications and adaptations be included within the scope of this disclosure, and the following claims.

What is claimed is:

1. A modular free standing upright display assembly, which comprises:

a) At least two base members;

b) At least two upright sub-assemblies, each upright sub-assembly with an outer tubular member having an upper end and a lower end, and an inner tubular member slidably received within the outer tubular member; the inner tubular member with an upper portion and a lower portion, the upper portion of the inner tubular member sized to extend above the upper end of the outer tubular member; and the inner and outer tubular members are selectively releasably secured between at least one extended position, and manually lowered to a retracted position for ease of transport or storage;

c) first and second radial positioning members, each with a cylindrical hub and an extended arm, the cylindrical hub radially positioned and releasably secured between one of the base members and one of the upright sub assemblies, the first and second radial positioning members each having a first side with a boss and at least two grooves thereon, the boss in the first radial positioning member positioned to engage a selected groove in the second radial positioning member, and the boss in the second radial positioning member positioned to engage a selected groove in the first radial positioning member, and the first and second radial positioning member adjustable between at least two positions, selected from: in-line, convex, concave and right angle positions;

d) third and fourth radial positioning members, each with a cylindrical hub and an extended arm, the cylindrical hub radially positioned and releasably secured above the upper portion of a selected one of the inner tubular members, the third and fourth radial positioning members each having a first side with a boss and at least two grooves thereon, the boss in the third radial positioning member positioned to selectively engage a groove in the fourth radial positioning member and the boss in the fourth radial positioning member positioned to selectively engage a selected groove in the third radial positioning member, the third and fourth radial positioning members adjustable between at least two positions, selected from: in-line, convex, concave and right angle positions;

e) a first lower horizontal bar releasably secured near one end to one of the extended arms of the first and second radial positioning members, and the first lower horizontal bar releasably secured near the opposite end to one of the first and second radial positioning members of an adjacent upright sub-assembly;

f) a first upper horizontal bar releasably secured near one end to one of the extended arms of the third and fourth radial positioning members, and the opposite end of the upper horizontal bar releasably secured near the opposite end to one of the extended arms of the third and fourth radial positioning members of an adjacent upright sub-assembly;

g) the modular free standing display assembly sized to receive a flexible display material, the flexible display material releasably secured at the upper end to the upper horizontal bar, and releasably secured at the lower end to the lower horizontal bar; and h) each of the upright sub-assemblies extendable in-line between extended and retracted positions.

2. The modular free standing display assembly of claim 1, expandable with one or more additional base members and one or more additional upright sub-assemblies positioned in spaced alignment, and releasably secured together with additional lower horizontal bars releasably secured to respective extended arms on adjacent first and second radial positioning members, and one or more additional upper horizontal bars releasably secured to respective extended arms on the second and third radial positioning members to form a linearly extended modular display assembly of extended length therebetween.

3. The modular free standing display assembly of claim 1, wherein the inner and outer tubular members are releasably secured between one or more extended and retracted positions with a plunger assembly secured near a lower end of the inner tubular member, the plunger assembly with a plunger tip sized to selectively engage at least one spaced aperture in the outer tubular member, to releasably secure the inner and outer tubular members in at least one selected position, and the plunger tip is manually depressed to slidably bias the inner and outer tubular members.

4. The modular free standing display assembly of claim 1, wherein the radial positioning member comprises:

a) a cylindrical portion with a first side, and a second side in parallel spaced relation with the first side; with a center aperture extending through the cylindrical portion;

b) The first side of the cylindrical portion with a boss and a plurality of grooves radially extending from the center aperture to one side of the cylindrical portion; the boss and the grooves positioned to provide at least two positions selected from convex, concave, in-line and right angle positions;

c) an extended arm perpendicular to the first side and extending to one side of the cylindrical portion; the extended arm with a linear front face extending from the outer circumference of the cylindrical portion and a back face in spaced relation from the front face, with at least one aperture extending through the extended arm.

5. The radial positioning member of claim 4, wherein the first side of a first radial positioning member may be turned upside down to align the central aperture in the first radial positioning member with the central aperture in the second radial positioning member and to engage the boss on the first side of the first radial positioning member with a selected groove on the first side of a second radial positioning member; and to engage the boss on the first side of the second radial positioning member with a selected groove on the first side of the first radial positioning member; to align the extended arms on the first and second radial positioning members in one of at least two positions selected from:

convex, concave, in-line and right angle positions.

6. The free standing modular display assembly of claim 1, wherein each of the outer tubular members and the inner tubular members are sized to provide a loose fit there-between, and a first set of resilient spacers is secured to the inner surfaces of the outer tubular member near the upper end; and a second set of resilient spacers is secured to the outer surfaces of the inner tubular member near the lower end, to provide a resilient slip fit between the outer surfaces of the inner tubular member and the inner surfaces of the outer tubular member, enabling the respective inner tubular members and the outer tubular members to be manually biased between extended and retracted positions, while maintaining a substantially in-line linear alignment between the inner tubular member and the outer tubular member.

7. The free standing modular display assembly of claim 1, wherein an optional tensioning assembly comprises:

a) a short length of outer tubular material is slidably received over a portion of the upper end portion of the inner tubular member;

b) an upper threaded support member is secured to the upper end of the short length of outer tubular material;

c) a stop washer rests upon the upper end of the inner tubular member;

d) a compression spring extends between the stop washer and the upper threaded support member;

e) a threaded bolt extends through an aperture in the stop washer and the compression spring to engage the lower end of the upper threaded support member, the threaded bolt further extends through the central aperture in the third and fourth radial positioning members to secure to internal threads in a suitable handle; so that when the handle is tightened, the third and fourth radial positioning members are compressed against the upper threaded support member to secure the third and fourth radial positioning members in a selected position, and when the handle is loosened, the third and fourth radial positioning members are loosened to adjustably position the third and fourth radial positioning members in a radial position selected from one of at least two positions selected from: a concave, convex, in-line, and right angle positions;

f) an upper resilient spacer is secured to the outer surfaces on the upper end of the inner tubular member, and a lower resilient spacer is secured to the inner surfaces of the lower end of the short length of outer tubular material, to provide an in-line slip fit there-between; and the upper and lower resilient spacers further serve to limit travel of the short length of outer tubular material, thus providing limited travel there-between.

8. The free standing modular display assembly of claim 1, wherein each of the first and second horizontal bars have a rectangular cross section with a narrow width and an elongated height, and are sized and positioned to radially bend in the horizontal direction between adjacent upright sub-assemblies in a selected concave or convex position, while resisting bending in the vertical direction.

9. The free standing modular display assembly of claim 1, wherein a selected length of cord, rope, strap or bar extends between adjacent upright sub-assemblies and is sized to aid in selectively flexing the first and second horizontal bars in the horizontal direction into one of a convex and a concave position.

10. The free standing modular display assembly of claim 1, wherein each elongated base member preferably comprises:

a) a horizontal raised top portion with a centered aperture there-through;

b) a notch extending through the horizontal raised top portion from the centered aperture to a side portion of the horizontal raised top portion;

c) depending portions positioned on each end of the raised top portion; and d) horizontal feet extending beyond the lower side of each of the depending side portions in spaced parallel relation to the horizontal raised top portion; and e) the horizontal raised top portion sized to receive a rotatable handle beneath the centered aperture in the raised top portion and between the horizontal feet.

11. A free standing modular display assembly, comprising: a) at least three base members; b) at least three upright sub-assemblies, each upright sub-assembly with an outer tubular member having an upper end and a lower end, and an inner tubular member slidably received within the outer tubular member; the inner tubular member with an upper portion and a lower portion, the upper portion of the inner tubular member sized to extend above the upper end of the outer tubular member and the inner and outer tubular members selectively releasably secured between one or more extended and retracted positions; c) the inner and outer tubular members releasably secured between one or more extended and retracted positions with a plunger assembly releasably secured near a lower end of the inner tubular member, the plunger assembly with a plunger tip biased to selectively engage a selected aperture in the outer tubular member; d) first and second radial positioning members, each with a cylindrical hub and an extended arm with at least one aperture therethrough, the cylindrical hub with a first side radially positioned and releasably secured between each of the base portions and the upright sub assemblies; e) third and fourth radial positioning members, each with a cylindrical hub and an extended arm, with at least one aperture there-through, the cylindrical hub with a first side radially positioned and releasably secured above the upper portion of the inner tubular member; f) at least two sets of first lower horizontal bar, each releasably secured near one end to one of the extended arms of the first and second radial positioning members, and the first lower horizontal bar releasably secured near the opposite end to one of the first and second radial positioning members of an adjacent upright sub-assembly; g) at least two sets of second horizontal bars, each upper horizontal bar releasably secured near one end to one of the extended arms of the third and fourth radial positioning members, and the second upper horizontal bar releasably secured near the opposite end to one of the extended arms of the third and fourth radial positioning members of an adjacent upright sub-assembly; h) the modular free standing display assembly sized to receive at least two flexible display material thereon, each flexible display material releasably secured at the upper end to one second horizontal bar, and releasably secured at the lower end to one first horizontal bar, wherein the radial positioning member comprises: a) cylindrical hub portion with a first side and a second side in parallel spaced relation with the first side; with a central aperture centered through the cylindrical hub portion; b) The first side of the cylindrical hub portion with a boss and a plurality of grooves radially extending from one side of the center aperture; the boss and the grooves positioned to provide at least several positions selected from convex, concave, in-line and right angle positions; c) an extended arm extending to one side of the cylindrical hub portion; the extended arm with a linear front face extending from the outer circumference of the cylindrical hub portion and a back face in spaced relation from the front face, with at least one aperture extending through the extended arm.

12. The radial positioning member of claim 11, wherein the first side of a first radial positioning member may be turned upside down to engage a boss on the first side of a second radial positioning member with a selected groove on the first side of a second radial positioning member, and a boss on the first side of the second radial positioning member engages a groove on the first side of the first radial positioning member; to align the extended arms on the first and second radial positioning members in one of at least several positions selected from: convex, concave, in-line and right angle positions.

13. The modular free standing display assembly of claim 11, wherein each of the outer tubular members and the inner tubular members are sized to provide a loose fit there-between, and a first set of resilient spacers is secured to the inner surfaces of the outer tubular member near the upper end; and a second set of resilient spacers is secured to the outer surfaces of the inner tubular member near the lower end, to provide a resilient slip fit between the outer surfaces of the inner tubular member and the inner surfaces of the outer tubular member, enabling the inner tubular members and the outer tubular members to resiliently slide between extended and retracted positions, while maintaining a substantially in-line linear alignment between the inner tubular member and the outer tubular member, and to limit travel of the inner tubular member in relation to the outer tubular member.

14. The free standing modular display assembly of claim 11, wherein a length of cord is tensioned between adjacent upright sub-assemblies to aid in selectively flexing the first and second horizontal bars into one of a horizontal convex and a horizontal concave position.

15. The free standing modular display assembly of claim 11, wherein an optional tensioning assembly comprises:

a) a short length of outer tubular material is slidably received over the upper end portion of the inner tubular member;

b) an upper threaded support member is secured to the upper end of the short length of outer tubular material;

c) a stop washer rests upon the upper end of the inner tubular member;

d) a compression spring extends between the stop washer and the upper threaded support member;

e) a threaded bolt extends through an aperture in the stop washer and the compression spring to engage the threads on the upper threaded support member, the threaded bolt further extends through the third and fourth radial positioning members to engage and secure to internal threads in a suitable handle; so that when the handle is manually tightened, the third and fourth radial positioning members are compressed to secure the third and fourth radial positioning members in a selected radial position, and when the handle is manually loosened, the third and fourth radial positioning members may be adjustably positioned in one of: a concave, convex, in-line and right angle positions; and f) an upper hook or loop material is secured to the outer surfaces on the upper end of the inner tubular member, and a lower hook or loop material is secured to the inner surfaces of the lower end of the short length of outer tubular material, to provide an in-line, resilient slip fit there-between; and the upper and lower hook or loop materials serve to limit travel of the short length of outer tubular material, thus providing limited expansion to ensure that the flexible display material secured to the first and second horizontal members is kept taunt and free of wrinkles.

16. The free standing modular display assembly of claim 11, wherein each elongated base member preferably comprises:

a) a horizontal raised top portion with a centered aperture therethrough; the raised top portion sized to receive a rotating handle positioned beneath the centered aperture on the raised top portion;

b) depending side portions positioned on each end of the raised top portion, the depending side portions sized to provide clearance between the handle and the horizontal feet extending beyond each side of the depending side portions.

17. A free standing modular display assembly, comprising:

a) At least three upright sub-assemblies, each upright sub-assembly with an outer tubular member having an upper end and a lower end, and an inner tubular member slidably received within the outer tubular member; the inner tubular member with an upper portion and a lower portion, the upper portion of the inner tubular member sized to extend above the upper end of the outer tubular member;

b) a base member for each upright sub-assemblies;

c) each upright sub-assembly with inner and outer tubular members releasably secured between one or more extended positions with a plunger assembly secured near a lower end of the inner tubular member, the plunger assembly with a plunger tip biased to selectively engage an aperture in the outer tubular member to releasably secure the inner and outer tubular members in an extended position;

d) each of the upright sub-assemblies with first and second radial positioning members, each with a cylindrical hub and an extended arm with at least one aperture therethrough, the cylindrical hub with a first side and a second side in parallel spaced relation with the first side, with a center aperture centered through the cylindrical hub; the first side of the cylindrical hub with a boss and a plurality of grooves radially extending from the center aperture, the boss and the grooves positioned to provide a position selected from convex, concave, in-line and right angle positions, the cylindrical hub radially positioned and selectively secured between each of the base portions and the upright sub assemblies;

e) each of the upright sub assemblies with third and fourth radial positioning members, each with a cylindrical hub and an extended arm, the cylindrical hub with a first side and a second side in parallel spaced relation with the first side, with a center aperture centered through the cylindrical hub; the first side of the cylindrical hub with a boss and a plurality of grooves radially extending from the center aperture, the boss and the grooves positioned to provide a position selected from convex, concave, in-line and right angle positions, the cylindrical hub radially positioned and selectively secured above the upper portion of each of the inner tubular members;

f) at least two first lower horizontal bars secured near one end to one of the extended arms of the first and second radial positioning members, and the first lower horizontal bar secured near the opposite end to one of the first and second radial positioning members of an adjacent upright sub-assembly;

g) at least two first upper horizontal bars secured near one end to one of the extended arms of the third and fourth radial positioning members, and the second upper horizontal bar secured near the opposite end to one of the extended arms of the third and fourth radial positioning members of an adjacent upright sub-assembly;

h) the modular free standing display assembly sized to receive at least two flexible displays with indicia thereon, the flexible display releasably secured at the upper end to the second horizontal bar, and releasably secured at the lower end to the first horizontal bar;

i) at least three tensioning assemblies, each with a short length of outer tubular material slidably received over the upper end portion of each of the inner tubular members;

j) at least three upper threaded support members, each upper threaded support member secured to the upper end of the short length of the respective outer tubular material;

k) at least three stop washers positioned upon the upper end of each respective inner tubular member;

l) at least three compression springs positioned to extend between the respective stop washer and the respective upper threaded support member;

m) at least three threaded bolts positioned to extend through a respective aperture in the stop washer and the compression spring to engage the threads on the upper threaded support member, the threaded bolts further extend through the third and fourth radial positioning members to engage and secure to the respective internal threads in a suitable handle; so that when the handle is manually tightened, the third and fourth radial positioning members are respectively compressed to releasably secure the third and fourth radial positioning members in a selected position, and when the handle is loosened, the third and fourth radial positioning members may be respectively adjustably positioned in one of: a concave, convex, in-line and right angle positions;

n) each upright sub-assembly with an upper hook or loop material respectively secured to the outer surfaces on the upper end of the inner tubular member, and a lower hook or loop material respectively secured to the inner surfaces of the lower end of the short length of outer tubular material, to provide a resilient, in-line slip fit there-between; and the upper and lower hook or loop materials serve to limit travel of the short length of outer tubular material, thus providing limited expansion to ensure that the flexible display material secured to the respective first and second horizontal members is kept taunt and free of wrinkles.

18. The free standing modular display assembly of claim 17, wherein each of the outer tubular members and the inner tubular members are sized to provide a loose fit there-between, and a first set of resilient spacers are secured to the inner surfaces of the outer tubular member near the upper end; and a second set of resilient spacers are secured to the outer surfaces of the inner tubular member near the lower end, to provide a resilient slip fit between the outer surfaces of the inner tubular member and the inner surfaces of the outer tubular member, enabling each of the inner tubular members and the outer tubular members to move easily between extended and retracted positions, while maintaining a substantially in-line linear alignment between the inner tubular member and the outer tubular member.

19. The elongated base member of claim 17*b*), comprising:

a) a horizontal raised top portion with opposing sides;

b) an aperture centered in the horizontal raised top portion;

c) a notch extending from the aperture to one side of the raised top portion;

d) depending side portions on each end of the raised top portion e) horizontal feet extending beyond each side of the depending side portions;

f) a resilient hub with an outer portion sized to be slidably received in the notch; an inner diameter of the resilient hub sized to closely receive a portion of a threaded bolt extending through the central aperture in the first and second radial positioning members; and g) first and second large washers located above and below the resilient hub; and h) the first and second large washers sized to clamp the raised top portion of the base member between the first and second large washers when the threaded bolt is manually tightened to partially compress and releasably secure the resilient hub in a position selected from: in-line, convex, concave, and right angle positions.

* * * * *